US011867000B1

(12) United States Patent
Burns

(10) Patent No.: US 11,867,000 B1
(45) Date of Patent: Jan. 9, 2024

(54) SWIVEL STAND APPARATUS AND ASSOCIATED EQUIPMENT

(71) Applicant: SWIVEL RENTAL & SUPPLY, L.L.C., Lafayette, LA (US)

(72) Inventor: Douglas C. Burns, Youngsville, LA (US)

(73) Assignee: SWIVEL RENTAL & SUPPLY, L.L.C., Lafayette, LA (US)

( * ) Notice: Subject to any disclaimer, the term of this patent is extended or adjusted under 35 U.S.C. 154(b) by 0 days.

(21) Appl. No.: 17/568,371

(22) Filed: Jan. 4, 2022

Related U.S. Application Data

(63) Continuation of application No. 17/014,518, filed on Sep. 8, 2020, now Pat. No. 11,248,420, which is a continuation of application No. 15/904,035, filed on Feb. 23, 2018, now Pat. No. 10,815,735.

(60) Provisional application No. 62/634,564, filed on Feb. 23, 2018, provisional application No. 62/462,730, filed on Feb. 23, 2017.

(51) Int. Cl.
*E21B 15/00* (2006.01)
*E21B 19/10* (2006.01)

(52) U.S. Cl.
CPC ..... *E21B 15/003* (2013.01); *E21B 19/10* (2013.01)

(58) Field of Classification Search
CPC ..... E21B 15/003; E21B 19/10
USPC ..... 166/75.11
See application file for complete search history.

(56) References Cited

U.S. PATENT DOCUMENTS 8,793,960 B1 * 8/2014 Burns ..... E21B 7/02 166/85.1

* cited by examiner

*Primary Examiner* — Anita M King
(74) *Attorney, Agent, or Firm* — Garvey, Smith & Nehrbass, Patent Attorneys, L.L.C.; Seth M. Nehrbass; Fabian M. Nehrbass

(57) ABSTRACT

A swivel stand apparatus includes a swivel tower and a swivel mounting frame to which the swivel tower preferably removably attaches. Non-wheeled friction reducing sliders preferably form an interface between the swivel mounting frame and the frame. The flanged beams are part of a basket which can receive and connect to either a jack base or a flange base. The basket can have legs of different lengths to allow connection of the basket to the bases in only one orientation to prevent incorrect connection of the basket to the base. The basket preferably includes specially configured pipe racks for holding vertically positioned pipe or pipe joints. The jack base preferably includes multiple legs to connect to legs of the basket, and two legs to contact and support the basket without necessarily being mechanically interlocked thereto.

19 Claims, 25 Drawing Sheets

SWIVEL STAND APPARATUS AND ASSOCIATED EQUIPMENT

CROSS-REFERENCE TO RELATED APPLICATIONS

This is a continuation of my U.S. patent application Ser. No. 17/014,518, filed 8 Sep. 2020 (issued as U.S. Pat. No. 11,248,420 on 15 Feb. 2022), which is a continuation of U.S. patent application Ser. No. 15/904,035, filed 23 Feb. 2018 (issued as U.S. Pat. No. 10,815,735 on 27 Oct. 2020), which claims the benefit of my U.S. provisional patent application No. 62/462,730, filed 23 Feb. 2017, and my U.S. provisional patent application No. 62/634,564, filed 23 Feb. 2018, which are hereby incorporated herein by reference and priority of which is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an improved swivel stand apparatus for use on oil wells.

2. General Background of the Invention

SWIVEL RENTAL & SUPPLY, L.L.C. has been issued several patents on equipment that can advantageously be used with the apparatus of the present invention (see U.S. Pat. Nos. 8,793,960, and 9,217,297). The present invention is directed to improved features of its previously patented swivel apparatus.

U.S. Pat. No. 8,793,960 (issued on 5 Aug. 2014); U.S. Pat. No. 9,217,297 (issued on 22 Dec. 2015); U.S. Pat. No. 9,650,841 (issued on 16 May 2017); and U.S. Pat. No. 9,938,778 (issued on 10 Apr. 2018).

Also incorporated herein by reference is all prior art cited in those patent documents and the prior art attached to and/or incorporated by reference in my U.S. Provisional patent application No. 62/634,564, filed 23 Feb. 2018.

BRIEF SUMMARY OF THE INVENTION

The drilling process for oil and gas exploration typically requires the installation of production tubing that extends from the underground oil and gas reservoir to the well surface. This production tubing serves as a conduit for the recovery of the oil and gas from the reservoir. The production tubing is typically placed in a protective pipe liner called a tubular casing. The tubular casing, in descending diameters, extends in many cases to hundreds of feet and often cement is placed within the annulus located between the tubular casing and the well bore to hold the tubular casing in place and to ensure a pressure-tight connection between the well surface and the oil and gas reservoir.

Usually the tubular casing remains within the well bore until it has been determined that no oil or gas reservoirs have been found or the reservoirs have been exhausted. In such cases, the well bore must be plugged and abandoned (P & A) as required by law or convention. When a well bore is plugged and abandoned, the casing tubular is typically removed to a desired or prescribed depth and disposed of in a safe manner.

In other cases, an existing well bore is often utilized to allow the well to be drilled in a different direction. Often in such cases, the drill bit being used to advance the drilling cannot pass through the previously installed tubular casing due to an obstruction. If that occurs, it is necessary to remove the casing tubular to a desired depth before drilling operations can be restarted.

In most wells there are at least four tubular strings, beginning with the largest, upper and outer most conductor pipe, the surface casing, the intermediate tubular and finally the production casing. The removal of the tubular casing when required is often very difficult due to the tremendous weight of the tubular strings and, in some cases, the cement that has been placed around and between the various tubular strings.

The removal of the tubular casing from the well, such as when a well is to be plugged and abandoned, generally begins by first inspecting the well and insuring that the well is inactive and free of any residual gas and that the well is safe to allow for removal of the blowout preventers, well head, and other well equipment that is positioned above the tubing hangers. A safe work platform is then established around the wellhead and associated equipment. That work platform is then used to create a bridge plug within the production tubular at a prescribed depth by applying cement to seal or plug the well casing. The production tubular is then cut at a prescribed depth below the surface using chemical cut, jet cut, mechanical cut or other such rotating cutting tools. The cutting tool is supported on the surface and rotated by a rotary swivel. A lifting device is then attached to the inner most tubular by screwing into or spearing the tubular tubing hanger.

Such lifting devices may be the rig's crane if available and not in use by other drilling operations on the site. The production tubular is then lifted to a desired length, usually approximately forty feet, where slips are set to hold the string, and tongs are used to uncouple the tubular joints. However, in many cases the drill casing tubular cannot be uncoupled in this manner. In the latter case, two diametrically opposing holes are cut in the casing and a bar is then inserted through the holes and the lifting device, such as a crane, is slaked off to allow the bar to rest on top of the well flange. The tubular is then flame cut just above the bar and the initial section of tubular is then removed. In some cases, where cement is present between the tubular strings, it becomes necessary to chip away the cement in order to cut the lifting bar holes. The crane then returns and is attached to the bar thus lifting the tubular string for another length and holes are again cut for a lifting bar. The process described above is then repeated for each tubular string until all the tubulars are removed.

Each incremental section of tubular usually requires operators to cut the casing, usually by torch, and manually drill two holes. The two holes are drilled from each side of the tubular in an attempt to keep them aligned with each other. It is essential that the holes be aligned with each other or large enough so that the bar or rod can be placed through the two holes. As discussed above, raising the tubular requires an extensive amount of force to overcome the resisting forces. Therefore, a stable platform is required. After the various increments of casing tubular are cut and pulled from the well bore, they are disposed of in a prescribed manner. Where holes drilled for the bars are individually and sequentially drilled in each incremental section of casing it is essential that proper tooling be used to maintain alignment. The operators usually drill one side at a time, a slow and tedious process, especially with heavy gauge pipe. In some cases up to two hours is required. The operator is required to drill a second hole that is diametrically opposite the first. In some cases the operator is fortunate enough to get the two holes lined up, but at other times the two holes did not line up and a bar could not be inserted through both holes in which case a torch is used to enlarge at least one of the holes so that the bar could be placed through both holes.

A dual drill system that drills holes from both sides simultaneously, thereby insuring alignment, may be used. Although the time required to drill the holes may be drastically reduced in such cases, a significant amount of time is still required to set up, and to clear, lubricate and repair the drill bits. In addition, a torch is still often used to cut each section of the tubular being removed. Since a torch is used to separate the tubular into reasonable lengths, it has become more prevalent to simply cut the holes with a torch as well. In view of the process described above, a faster and more efficient method is needed to perform these tasks with greater certainty.

In more recent years the P & A operation has included the use of a portable power swivel to assist in cutting casing down hole for removal. Such power swivels are generally portable hydraulic systems used on a well site having multiple well heads and where existing cranes are not always available for the P & A operation. Therefore, a temporary derrick must be erected adjacent the wellhead to be removed and the P & A operation carried out using the power swivel. Such derricks may or may not include a means for raising the well casing. In most cases a simple frame to support well casing cutting tools is sufficient to separate sections of the well casing. Such frames have evolved from a simple "A" frame structure to more complicated wellhead adapted frames having a vertical mast traversable in at least two planes.

However, in most cases the frames are fitted so as to include a power swivel and its cutting tools. However, in many cases such adaptation to an offshore wellhead is not necessary on well sites having multiple well heads. Such sites have very limited space available and therefore the size of the temporary derrick must be restricted. Therefore, a simple skid having a traversable mast to support a plurality of tools is all that is needed. There a power swivel may be one of several tools that may be adapted to the mast, thereby making the skid and mast assembly much more universal.

The present invention includes a swivel stand apparatus that improves my U.S. Pat. No. 8,793,960, including friction-reducing members and a locking mechanism for detachably locking the stand tower or mast to a swivel mounting frame.

It is better to detachably lock the stand tower to the stand horizontal beams using the locking mechanism because it is easier to rig up, especially where it is helpful to hoist the stand tower after the basket of the present invention is hoisted into place (with the locking members, the swivel stand tower can be lowered vertically onto the horizontal beams of the swivel mounting frame rather than laterally slid into place in the overlapping metal plates of the guide as in my U.S. Pat. No. 8,793,960).

The swivel stand of the present invention preferably uses flanged beams (e.g., channel beams) to allow the stand tower to slide back and forth (rather than using overlapping plates as in my U.S. Pat. No. 8,793,960). There are friction-reducing members for facilitating motion between the stand horizontal beams of the swivel mounting frame and the basket flanged beams (preferably attached to each of the stand horizontal beams at least on the bottom that contacts the flanged beams, and preferably on all surfaces that contact the flanged beams). There are friction-reducing members between the stand tower and the stand horizontal beams to help prevent electrolysis and to prevent wear of metal on metal.

The stand horizontal beams preferably have skids attached to the bottom thereof to allow the beams to slide up over the plates in the floor of the upper basket. These skids contact the plates to help stabilize the tower as rotating tools are used, and to help transfer load from the tower to the basket, not just through the flanged beams or C-channels. The stand horizontal beams preferably are attached together with, for example, at least one lateral beam to form a U-shaped base (a swivel mounting frame or skate).

The present invention also includes work baskets, including a modular work basket with multiple interchangeable parts to allow it to be used on the floor of an oil well drilling rig or directly attached to the wellhead. The work basket connects to at least two different bases. The work basket and the bases preferably connect together using legs which are sized so that the basket and bases can only connect in a single orientation (to prevent the base from being connected backwards, for example, to the basket). The work basket preferably has specially configured pipe supports that are used to support vertically positioned pipe sections, which are preferably pivotally attached thereto. Preferably, these allow multiple joints of pipe to be received therein and held in place vertically next to the work basket while operations occur.

There are three preferred basket and support base configurations. In one configuration the work basket is connected to a flange base (about 18-inch high) which can be bolted directly to a wellhead. This first configuration includes a square plate in the opening in the basket floor with a hinged door. Typically in this configuration jacks are not used.

In a second configuration, the upper work basket can be connected to a jack base (preferably about eight feet (8') wide by ten feet (10') long by eight feet (8') high) with a square plate in the opening in the basket floor, the square plate having a round opening for the jack to protrude through.

In a third configuration, the work basket is connected to a flange base (about 18-inch high) which is bolted directly to a wellhead, with an upper level jack platform in the opening in the basket floor. This configuration is typically used when one starts with the first configuration, and then jacks are needed.

The flange base can include preferably a thick base plate (about three inches (3") thick and about eighteen inches (18") high).

The jack base preferably has 5th and 6th legs (center supports or braces) to support the upper basket. With these center support braces the basket rests on them for load transfer. The upper work basket is also connected to corner legs of the jack base.

The apparatus of the present invention includes a rotating boom assembly which can advantageously be used with the swivel stands and associated equipment of the present invention. This rotating boom assembly preferably includes roller bearings to allow it to be rotated by a single worker.

The boom can provide a hydraulic arm with at least a 3-foot reach for moving items along the boom. Roller bearings and hydraulic arm together allow one man to do easily which formerly several men did with great effort. This boom arrangement also makes it safer for the workers. The rotating boom assembly is preferably mounted on the upper work basket.

It is better to detachably lock the stand tower or mast to the stand horizontal beams using the locking mechanism because it is easier to rig up, especially where it is helpful to hoist the stand tower or mast after the basket of the present invention is hoisted into place (with the locking members, the swivel stand tower can be lowered vertically onto the horizontal beams of the swivel mounting frame rather than laterally slid into place in the overlapping metal plates of the guide as in my U.S. Pat. No. 8,793,960).

The swivel stand of the present invention preferably uses flanged beams to allow the stand tower to slide back and forth. There are friction-reducing members (e.g., sliders) for facilitating motion between the stand horizontal beams of the swivel mounting frame and the basket flanged beams (preferably attached to each of the stand horizontal beams, at least on the bottom that contacts the beams, and can be on the sides as well. These friction-reducing members, e.g., sliders, can be located on three sides of the beams so that there is no metal-to-metal contact. There can be friction-reducing members between the stand tower and the stand horizontal beams to help prevent electrolysis and to prevent wear of metal on metal.

The stand horizontal beams can have skids attached to the bottom thereof to allow the beams to slide up over the plates in the floor of the basket. These skids contact the plates to help stabilize the tower as rotating tools are used. The stand horizontal beams preferably are attached together with for example at least one lateral beam to form a base in plan or top view (a swivel mounting frame).

There are three possible configurations of a basket and support base:

In one configuration, the work basket is connected to a flange base (about 18-inch high) which is bolted directly to a wellhead, with a square plate in the basket floor with a hinged door—typically in this configuration jacks are not used.

In a second configuration, the work basket is connected to a jack base with a square plate in the basket floor, the square plate having a round opening for the jack to protrude through.

In a third configuration, the work basket is connected to a flange base (about 18-inch high) which is bolted directly to a wellhead, with an upper level jack platform in the square opening in the basket floor. It is preferably sized such that the rectangular upper level fits in and covers the square hole in the basket floor. The upper level jack platform configuration 1 (without the upper level jack platform installed) goes in place of the square plate with a round hole.

In the third configuration, the jack sits on the upper level jack platform, and the upper level jack platform projects slightly above the basket floor, but just a little (about a mm or two) so that the snow-ski-like projections on the bottom of the skate can still ride up onto the upper level jack platform and so that the upper level jack platform does not cause a trip hazard. Having the upper level jack platform project slightly above the basket floor allows force on the platform project through the load transfer cone without being transferred through the basket.

The snow-ski-like projections on the bottom of the skate ride up onto the square plates (all 3—with round open hole, with door, and upper level jack platform with force transfer cone) to help transfer force from the skate to the square plates then to the basket (or in the case of the upper level jack platform with force transfer cone, to the flange base and wellhead below it). Due to the riding up onto the plates, it is helpful to have a friction-reducing slider on top of the skate in the flanged beam or C-channel to reduce friction between the flanged beam or C-channel and the skate when the snow-ski-like projections are over the square plates.

The jack base preferably has 5th and 6th support columns or legs (center supports) to support the basket. These center supports do not have to be mechanically interlocked to the work basket— the basket can just rest on them. The work basket is connected to the corner legs.

There is preferably as well a hydraulic arm with at least a three-foot reach for moving items along the boom. The roller bearings and hydraulic arm together allow one man to do easily which formerly several men did with great effort. This also makes it safer for the workers. The rotating boom assembly is preferably mounted on the work basket.

The present invention preferably includes a flanged beam track with friction-reducing sliders between the track and the swivel mounting frame (for example, made of polytetrafluoroethylene (PTFE, often sold under the trademark Teflon®), but could instead be made of ABS (acrylonitrile butadiene styrene) plastic or PVC (poly(vinyl chloride)) plastic, for example) (The sliders are preferably removable and replaceable after each cut so fouling by metal cuttings is not a problem—the sliders can be removably attached, for example, with screws to, for example, the swivel mounting frame). There is also preferably a friction-reducing slider between the swivel tower and the swivel mounting frame which slides on the track.

Typically, the jack base is used when the basket is used on beams on platforms.

Preferably at least some of the upper legs of the bottom baskets are different lengths to prevent mis-matching of the work basket to the flange base or jack base.

A locking mechanism allows quick connection and removal of the upper assembly to the sliding mast beams.

Solid PTFE (Teflon®) sliders, or skiis, which are easily removed and replaced, are preferably included between the bottom of the top assembly and the flanged beams.

A transfer cone is used upside down (square base up, round apex of cone down) to transfer load from above it directly to well Christmas tree (or blow out preventer BOP) without impacting the basket. This is advantageous because the basket only needs to be robust enough to hold personnel and tools, not the force that is generated by the jacks which rest on the square base of the transfer cone.

One or more embodiments of the swivel stand and basket apparatus of the present invention can rig up in ⅓ of the time that it takes some prior art apparatuses, due to the modular nature of the equipment. The parts relatively easily connect to one another. The work basket is larger than many prior art baskets. The baskets can be used without a swivel stand but usually the swivel stand will be used.

The basket of the present invention is designed to be attached to two bases of the present invention:

A relatively thick flange base (having for example, and preferably, a 3" thick base plate) about (18" high); and A jack base (which can be, for example, preferably about 8' wide by 10' long by 8' high); wherein the 5th and 6th legs (center support braces) of the jack base support the basket, but they are not mechanically connected—the basket just rests on them, and wherein the basket is connected to the corner legs of the jack base, as, for example, shown in the drawings).

In the basket opening, there are typically three items received—a square plate with a hinged door, a square plate with a round opening for jacks, or an upper level jack platform which protrudes through the opening from a flange base to allow the flange base to be used with jacks. The upper level jack platform includes a load transfer member to permit transfer of up to about 150 tons of load from above the basket floor to the flange base without regard for the load capacity of the basket.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 6:
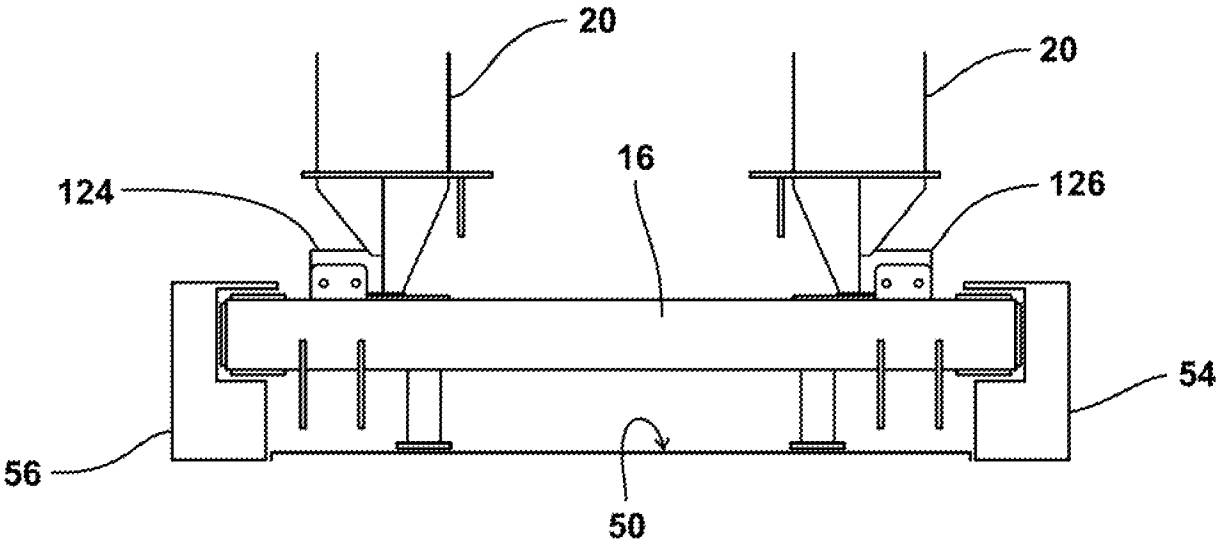
FIG. 6 is a partial sectional view of the preferred embodiment of the apparatus of the present invention.
Figure 8:
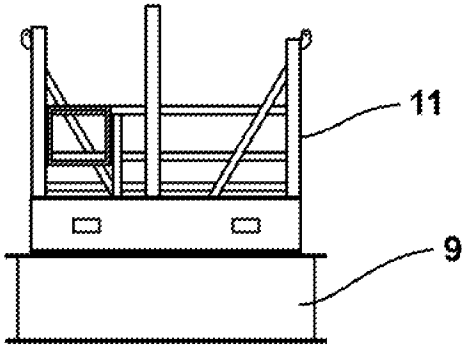
FIGS. 7-14 are sequential perspective views of the preferred embodiment of the apparatus of the present invention.
Figure 7:
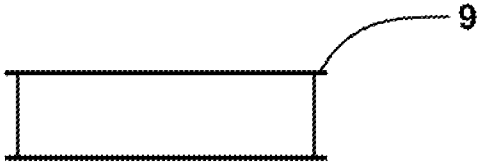
Figure 10:
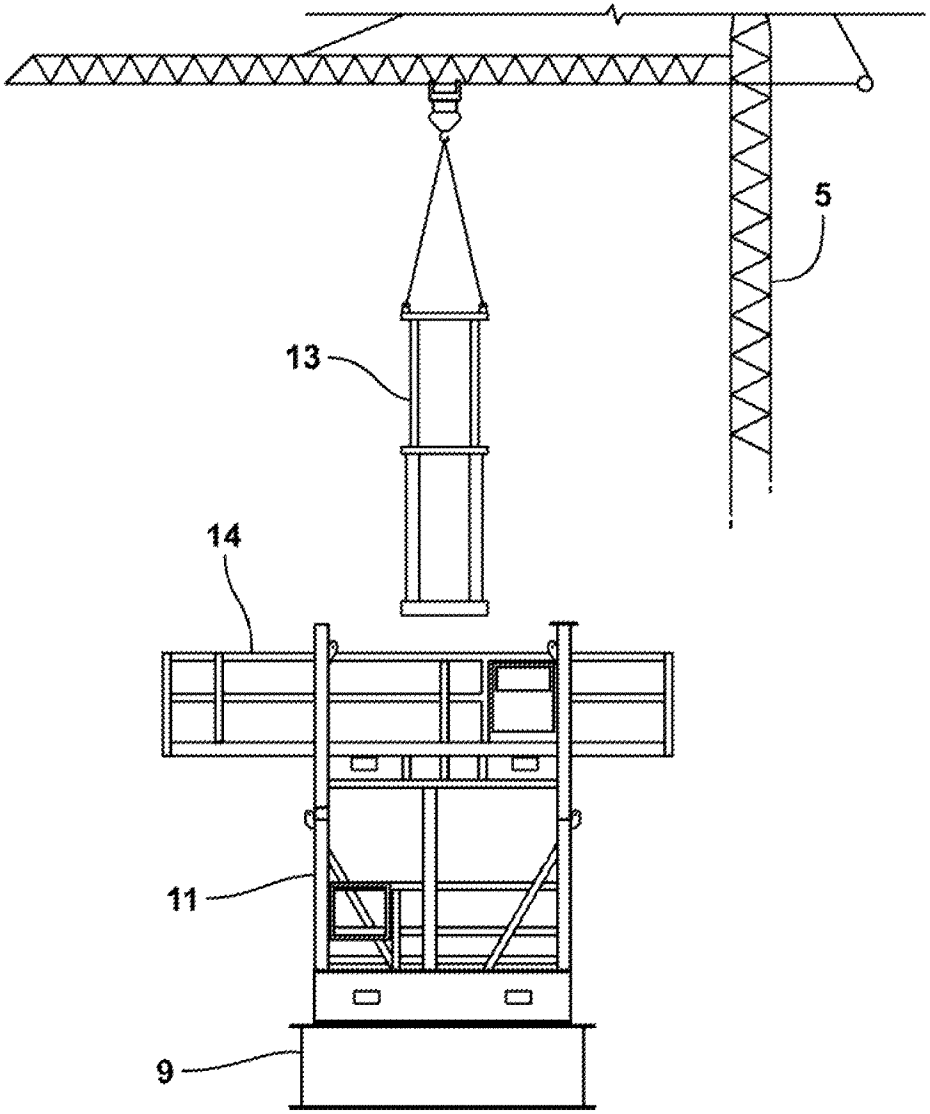
Figure 9:
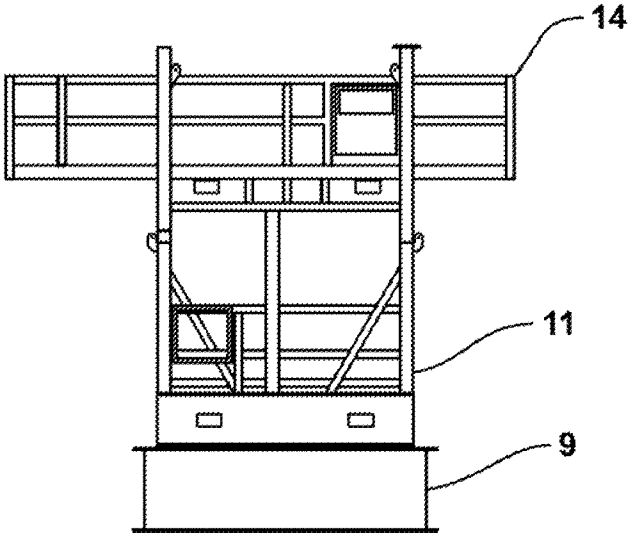
Figure 12:
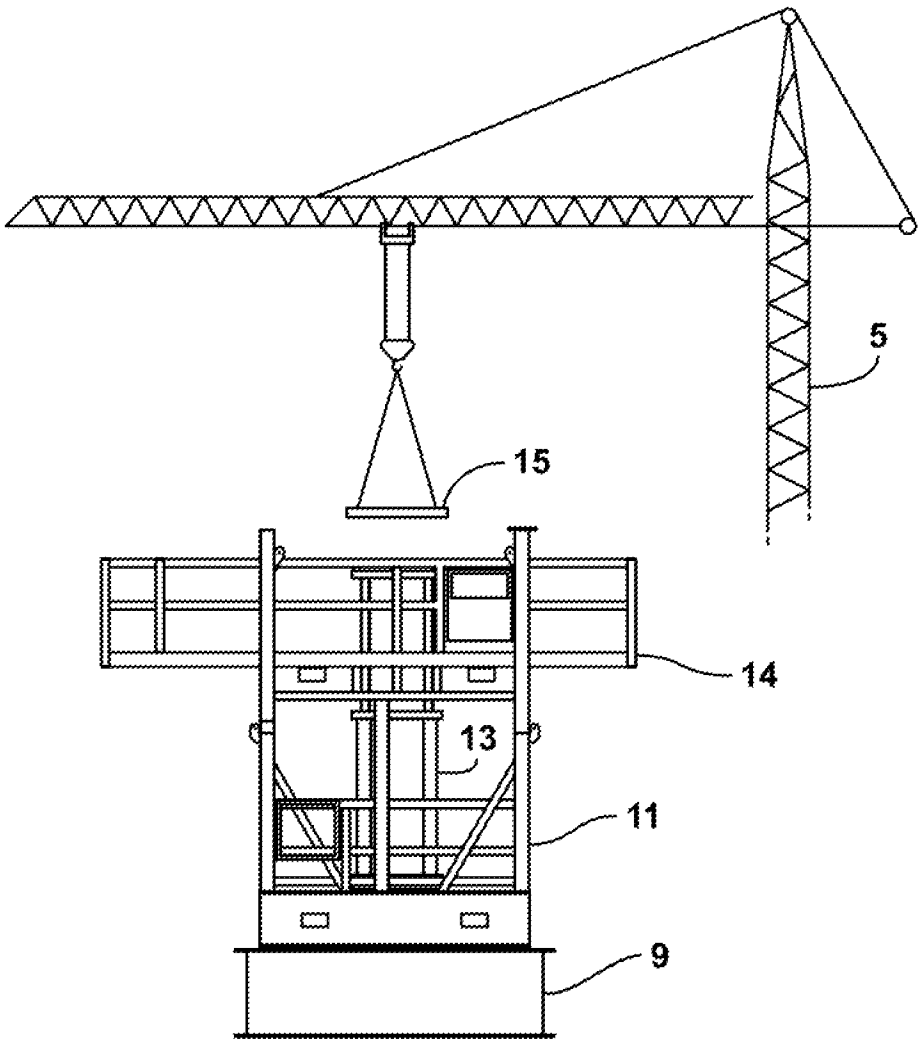
Figure 11:
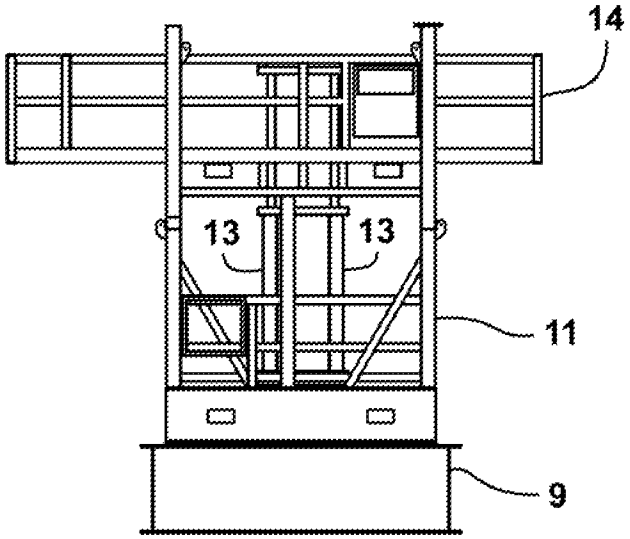
Figure 14:
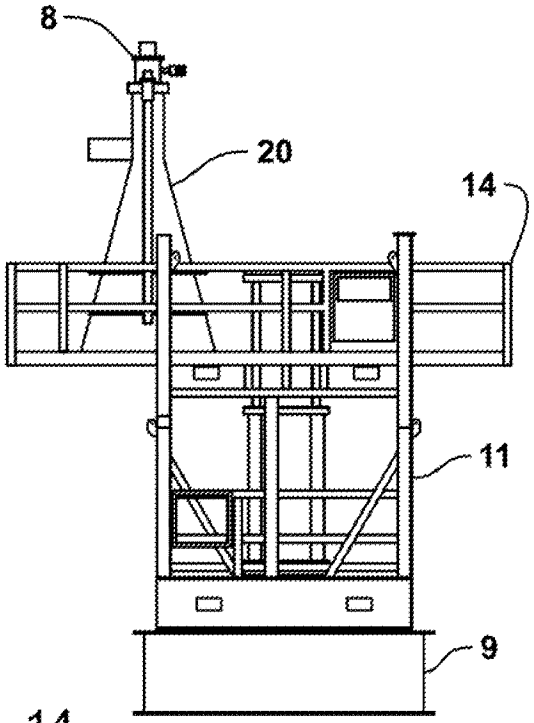
Figure 13:
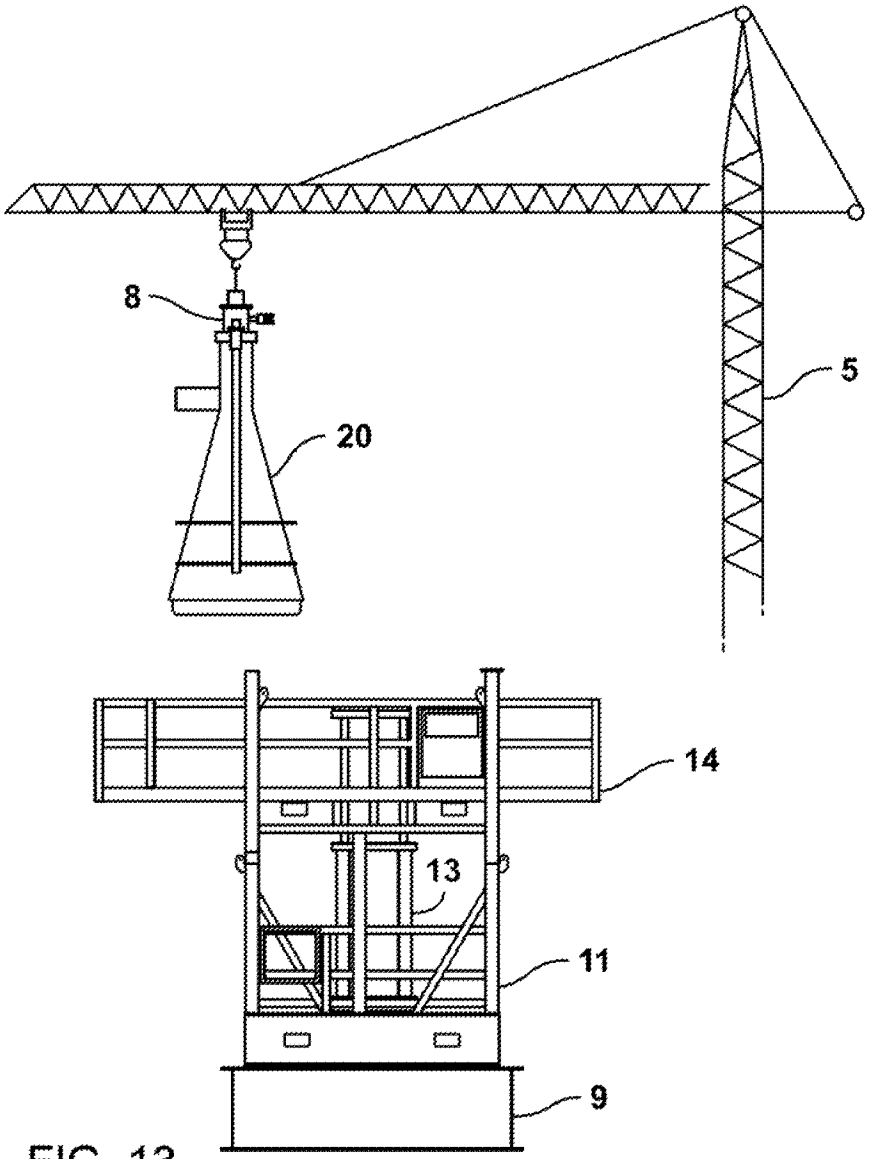
Figure 15:
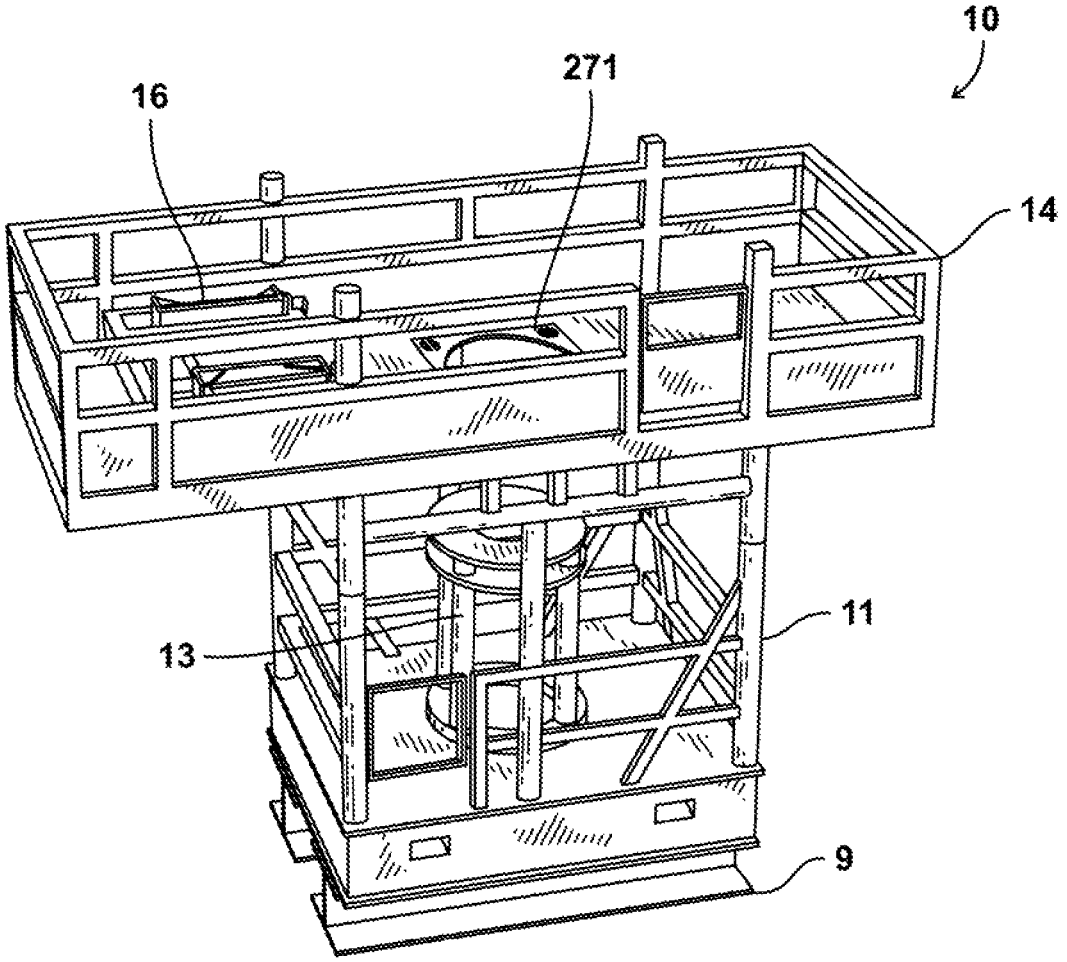
FIGS. 15-16 are perspective views of the preferred embodiment of the apparatus of the present invention.
Figure 16:
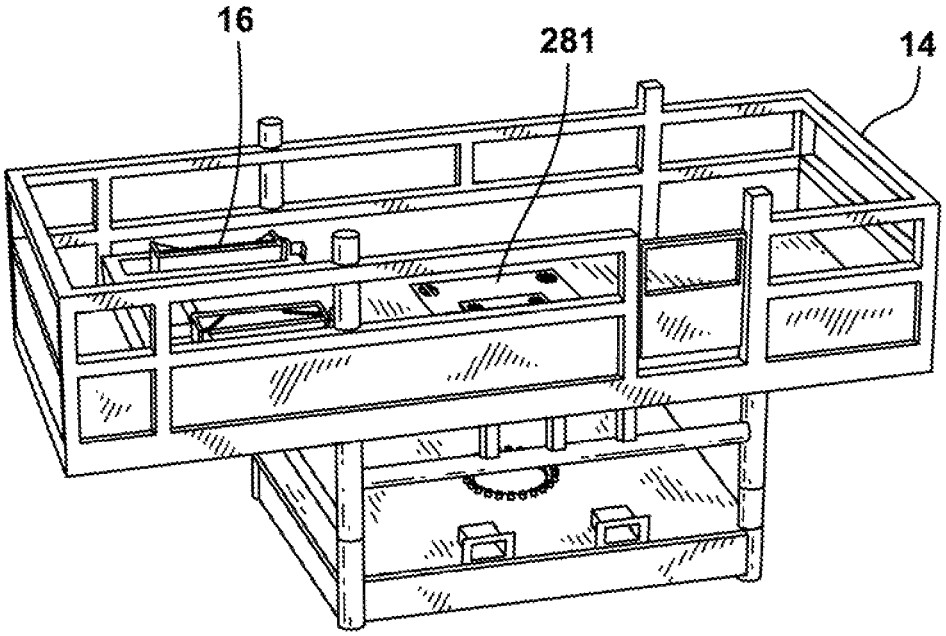
Figure 17:
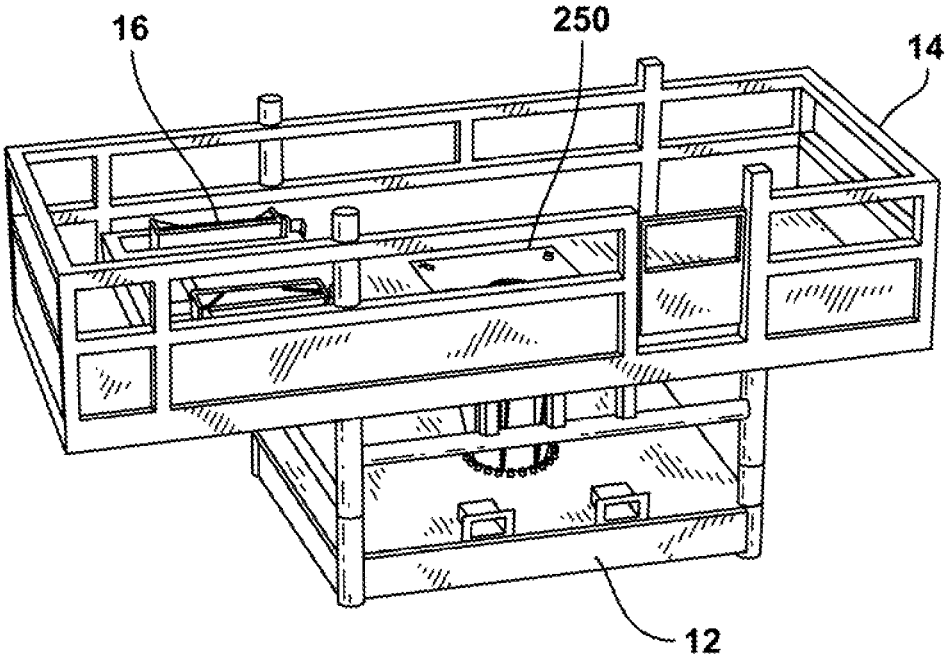
FIG. 17 is a perspective view of the preferred embodiment of the apparatus of the present invention.
Figure 22:
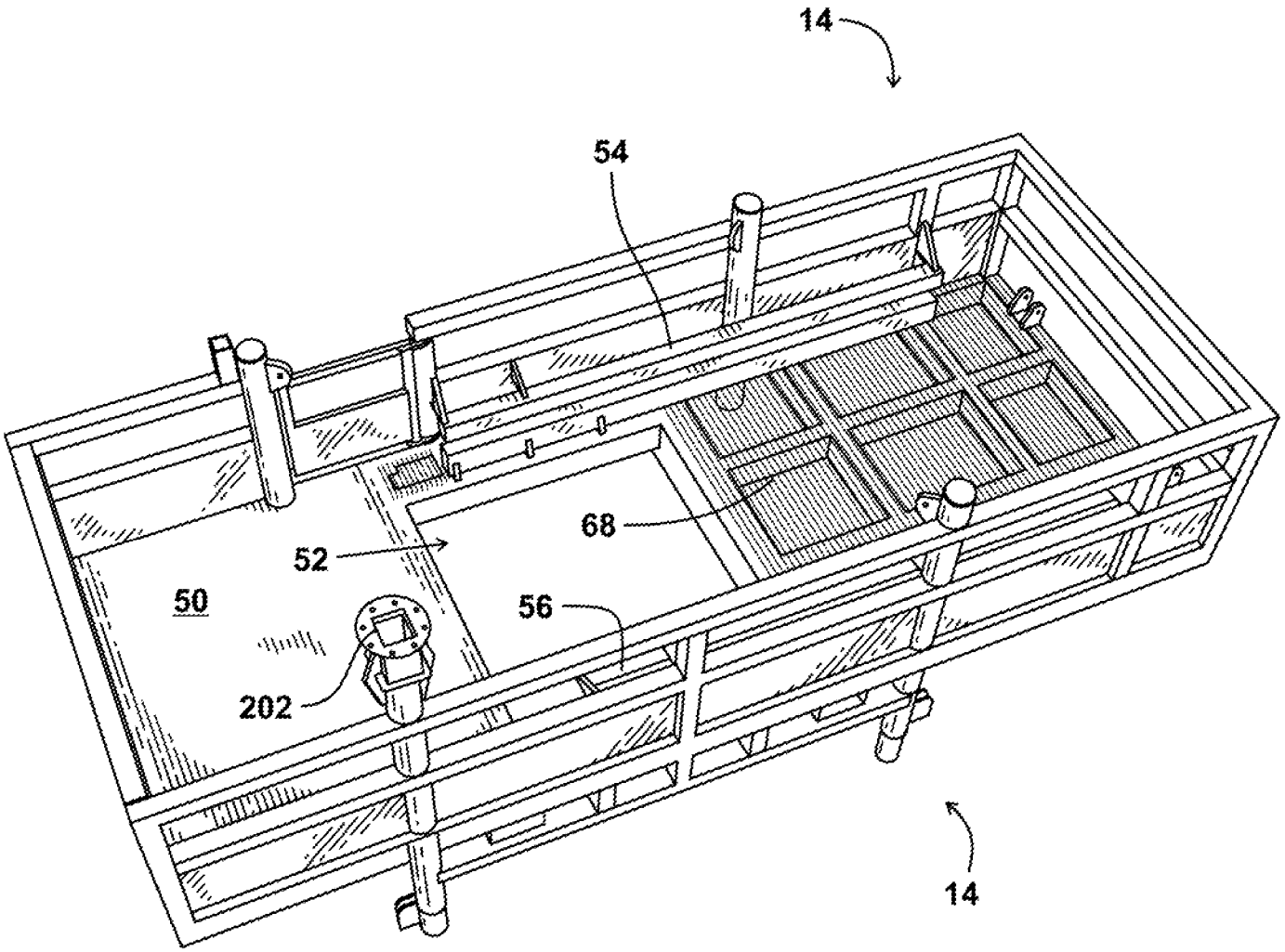
FIG. 22 is a fragmentary perspective view of the preferred embodiment of the apparatus of the present invention.
Figure 23:
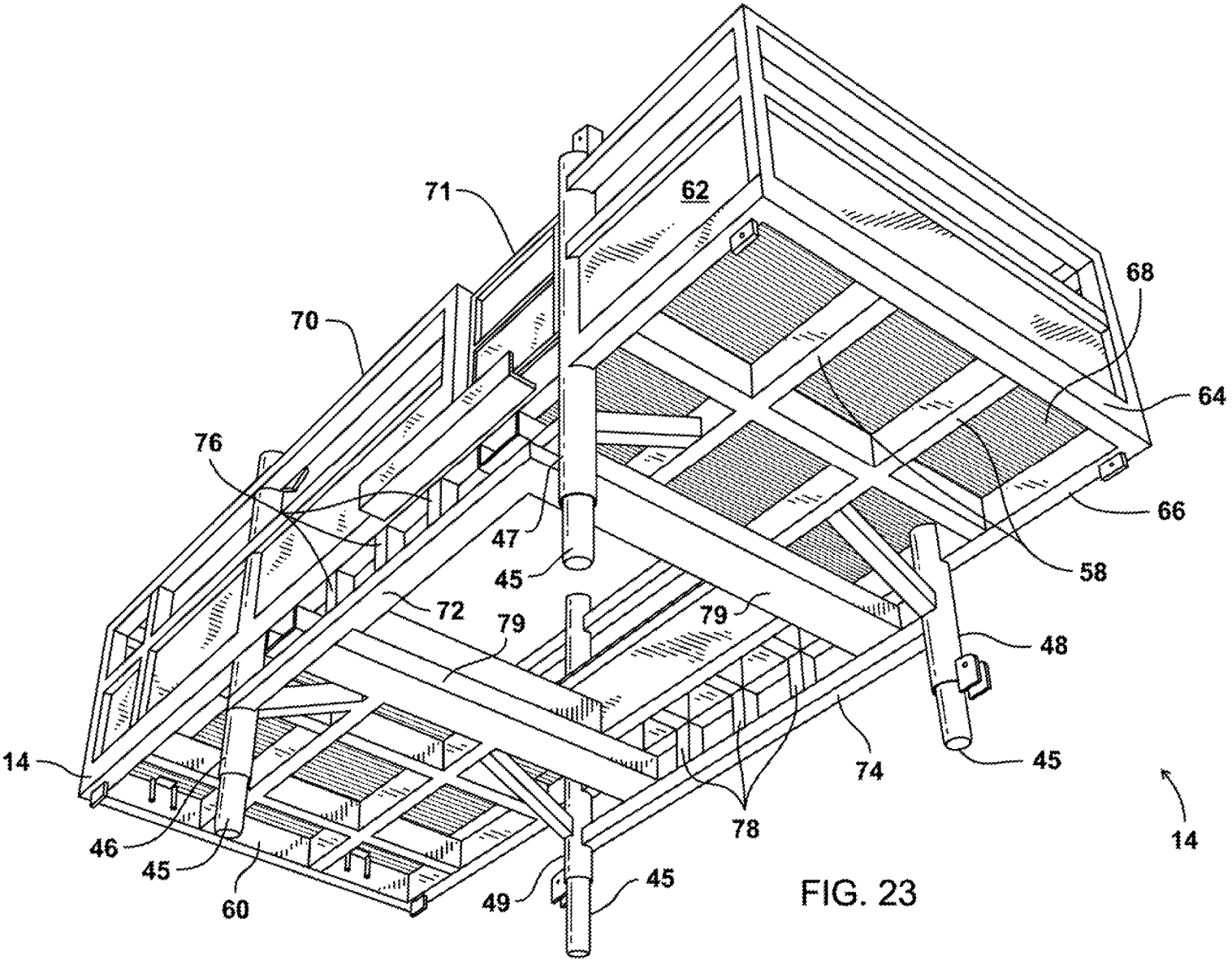
FIG. 23 is a fragmentary perspective view of the preferred embodiment of the apparatus of the present invention.

FIGS. 1-25 show a preferred embodiment of the apparatus of the present invention designated generally by the numeral 10. The apparatus of the present invention includes an improved swivel stand apparatus 10, designated generally by the numeral 10. Swivel stand apparatus 10 is used on an oil well drilling platform having a wellhead and blow out preventer (BOP), various tubular sections, and swivel or hydraulic swivel 8 (see FIGS. 13, 14). Swivel stand apparatus 10 includes two different lower level base arrangements including a jack base or base 11 (see FIGS. 8-16 and 21). Another base 12 (see FIGS. 17-20 and 24) is a lower level base that can be attached directly to a well head or blow out preventer (BOP). FIGS. 7-15 show a method of assembly of the apparatus 10 wherein base 11 is first placed on I beam foundation 9 (FIGS. 7-8). Basket 14 is attached to base 11. Jack structure 13 can be added using crane 5. Floor or deck plate 15 is then added to basket 14 deck 50 (see FIG. 22). Swivel tower 20 is then placed on skate 16 which is on deck 50 of basket 14. Skate 16 is seen in FIGS. 1-3, 4-6A, and 16-17.

Basket 14 or upper level 14 can optionally attach to either base 11 or 12. Skate or carriage 16 (FIGS. 1-3, 5-6, 26) slideably attaches to basket 14 and is movable between removed and operating positions. A mast or tower 20 can be lifted with a crane 5 (see FIGS. 13-14) and placed upon carriage 16 which is on basket 14. An improved clamping apparatus includes one or more clamps (e.g., see clamps 124, 126 of FIGS. 4-6) on skate or carriage 16. The clamping apparatus can be moved between released and locking positions. The clamping apparatus moves to the locking position in order to secure feet 21 (flanged beams or horizontal flanges) at the bottom of the mast or tower 20 to the skate or carriage 16.

Base 11 (FIG. 21) can include lower most beams 22, 23, 24, 25 and fork lift tine sockets 26. Beams 22, 23, 24, 25 can be flanged beams (e.g., I beams, channel beams, wide flanged beams). Base 11 provides corner columns, corner posts or legs 27, 28, 29, 30. Diagonal supports 31, 32 can be connected (e.g., welded) to each corner column 27-30. Each corner column 27-30 can provide a socket or bore 42 that is receptive of a stab fitting (or lower end portion) 45 of a column on basket 14 when basket 14 is attached to base 11.

In between each pair of corner columns, 27-30 there can be provided horizontal members 34, 35, 36. These include an upper horizontal member 34, a lower horizontal member 36, and a mid level horizontal member 35 that is in between the members 34, 36. Base 11 has deck 40 and deck opening 41.

A pair of support columns 37, 38 are provided on base 11. Each support column 37, 38 provides for load transfer between basket 14 and base 11. Each support column 37 is in between two corner columns 27, 28, 29 or 30. Columns 27, 28, 29, and 30 of base 11 can have lifting eyes 39. Stab fittings 45 on basket 14 (see FIG. 20) enable a connection to be made between basket 14 and base 11 or base 12. Basket 14 has columns 46, 47, 48, 49, deck 50 and deck opening 52. Columns 46, 47, 48, and 49 of basket 14 can also have lifting eyes.

Figure 24:
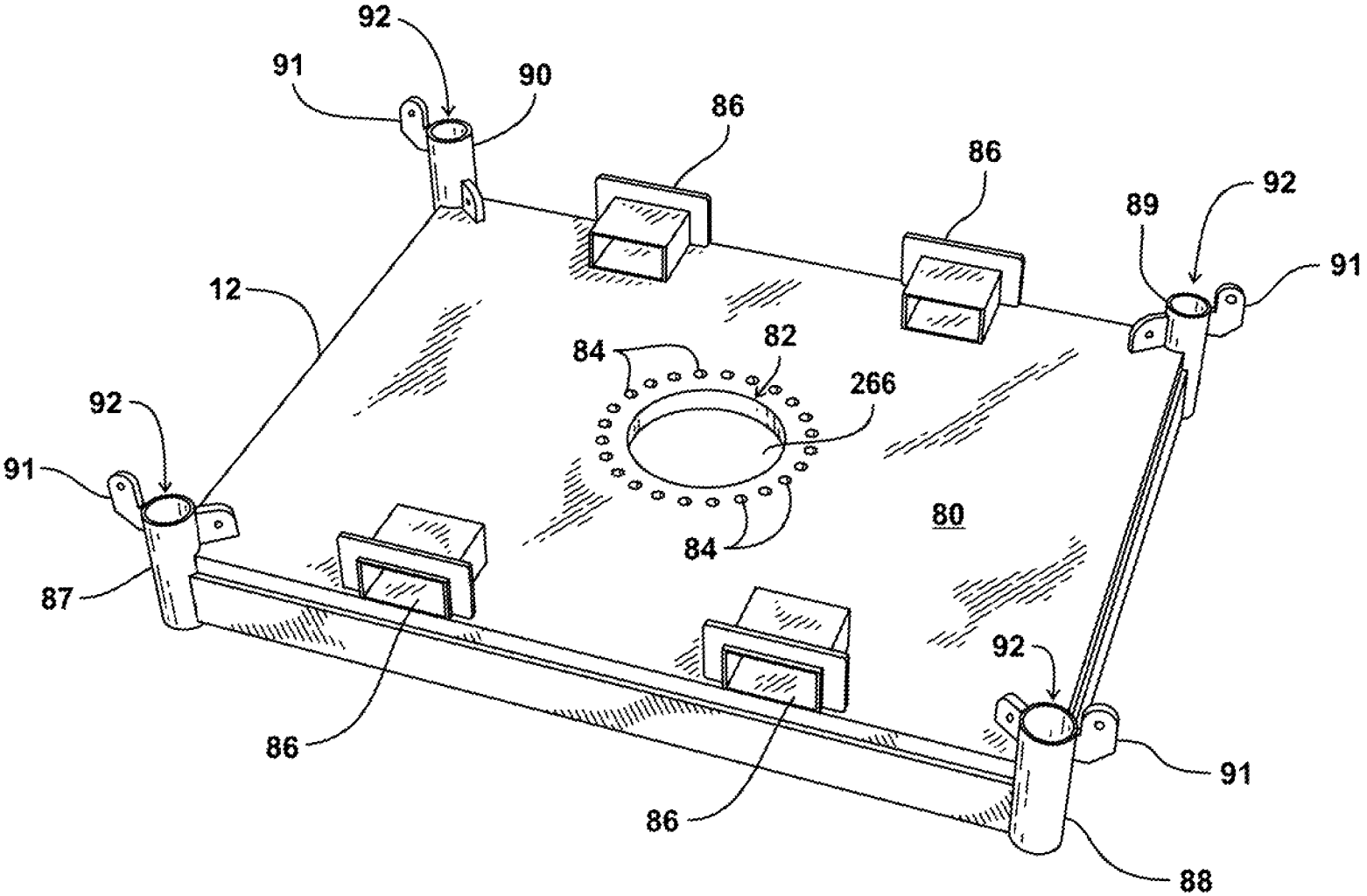
FIG. 24 is a fragmentary perspective view of a preferred embodiment of the apparatus of the present invention.
Figure 25:
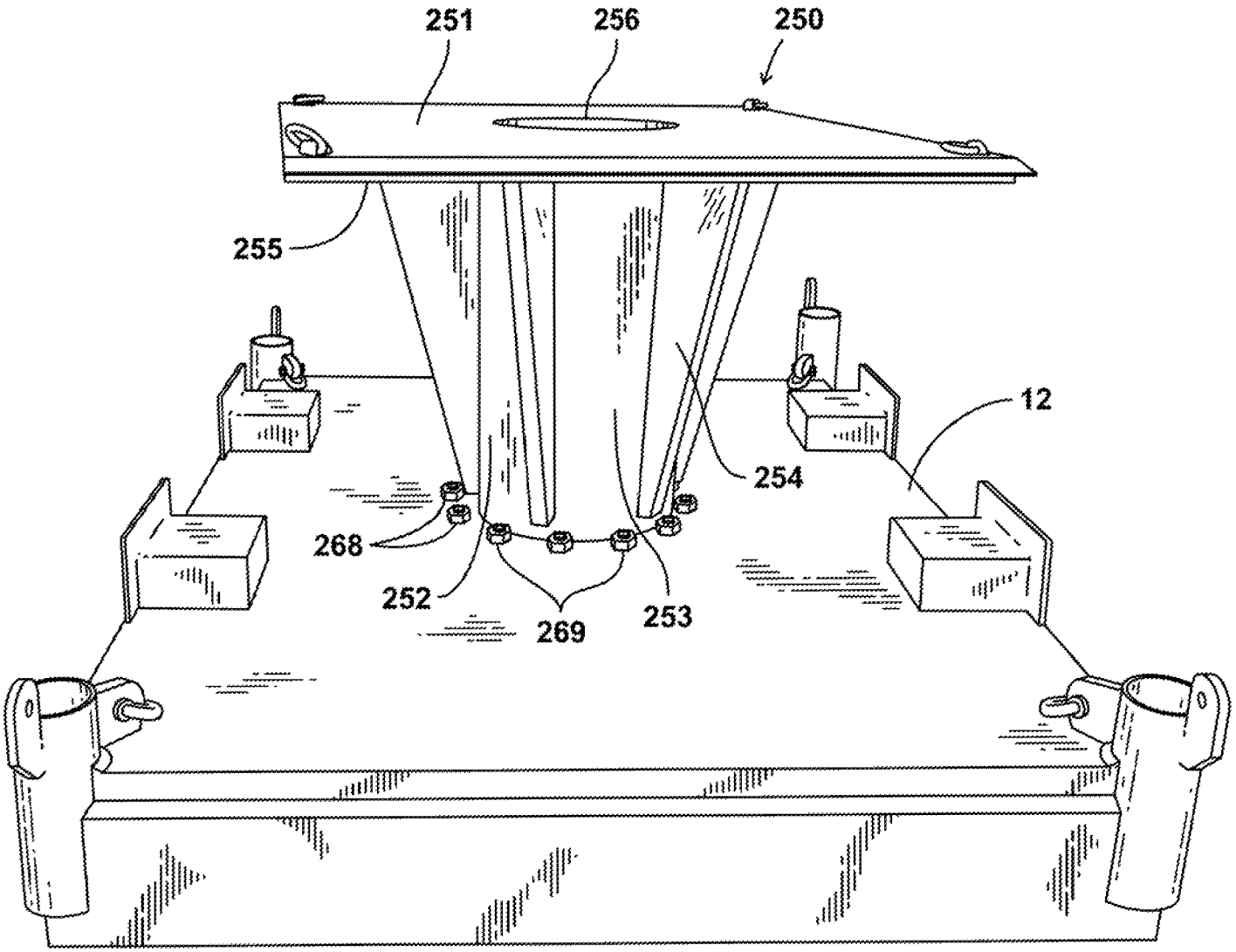
FIG. 25 is a fragmentary perspective view of a preferred embodiment of the apparatus of the present invention.
Figure 26:
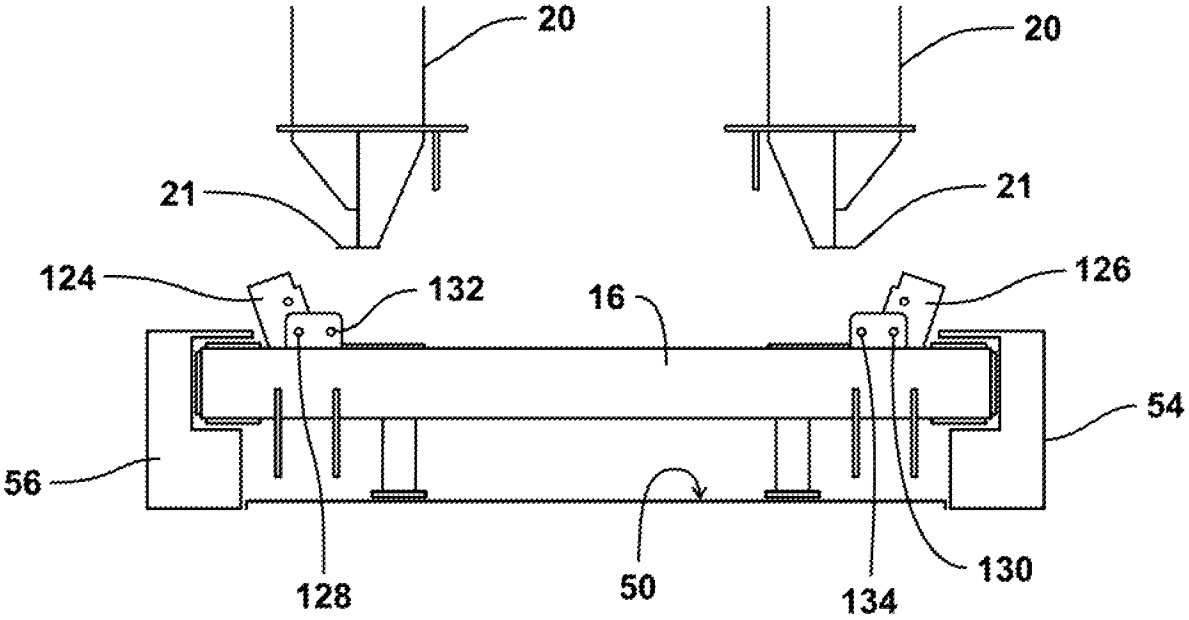
FIG. 26 is a partial sectional view of a preferred embodiment of the apparatus of the present invention.

Referring now to the embodiment of FIGS. 24-25, upper level jack platform with load transfer member 250 (FIG. 25) rests on plate 80 inside the bolt circle defined by bolt circle openings 84. Upper level jack platform with load transfer member 250 enables load transfer from platform 251 to plate 80 of base 12. Upper level jack platform with load transfer member 250 has a generally cylindrically shaped open ended bore 256 that aligns with plate 80 central opening 82. Cone 250 has generally square or rectangular plate 251 that fits opening 52 of deck 50. Plate 251 has opposed flanges at 255 which can rest upon deck 50 of basket 14. Upper level jack platform with load transfer member 250 can have a cylindrical sleeve 253 and gussets or reinforcement plates 254 that are welded to sleeve 253 and plate 251. The work basket can be connected to a flange base 12 which is bolted directly to a wellhead, with the upper level jack platform 251 in the square opening in the basket floor. Plate 251 is preferably sized such that it fits in and covers the square hole 52 in basket floor 50. Two flanges 255 (one on each end of the square plate 251) help prevent plate 251 (and thus cone 250) from rocking. These flanges 255 can be about ¼ inch thick and project outward about 4 inches from the square base plate 251. The upper level jack platform configuration (without the upper level jack platform installed goes in place of the square plate with a round hole in it). The opening in the upper level jack platform 251 can be for example about 20.5 inches in diameter. The outer diameter of the apex of the cone 250 of the upper level jack platform can be about 24 inches. The opening 266 in the flange base 12 can be about 20½" in diameter. The bolt circle can be about 30" in diameter (from outside edge of one hole to outside edge of the opposite hole) and about 27" in diameter (from inside edge of one hole to inside edge of the opposite hole). The apex of the cone fits inside the bolt circle without contacting the bolts or nuts which are screwed onto the bolts. The bottom of the load transfer cone contacts the flange plate and transfers force to the 3" flange base then to the wellhead. When properly placed on the flange base, the opening in the upper level jack platform aligns with the opening in the flange base.

In the third configuration, the jack sits on the upper level jack platform, and the upper level jack platform projects slightly above the basket floor, but preferably just a little (about ¼ inch) so that the upper level jack platform does not cause a trip hazard. Preferably there are about ¼ inch thick flanges on the ends of the square base as shown, and the platform is aligned such that those flanges will help the snow-ski-like projections on the bottom of the skate ride up onto the upper level jack platform (though typically this does not occur). Having the upper level jack platform project slightly above the basket floor allows force on the platform project through the load transfer cone without being transferred through the basket.

Flanged beams or channel beams 54, 56 on basket 14 are generally parallel to one another and provide runways for attaching skate or carriage 16 to platform or basket 14. Beams 54, 56 can be welded to basket 14 at opposed sides of basket 14 (see FIG. 22). Beams 54, 56 enable the skate or carriage 16 to slide relative to platform or basket 14 and its deck 50 (see FIGS. 5-6). Deck beams 58 can be provided to support grating 68. The deck beams 58 connect to (welded) the four peripheral beams 60, 62, 64 and 66. The beams 60 and 64 are end beams. The beams 62 and 66 are side beams. Basket 14 can be provided with railing 70 and entry door 71.

A pair of spaced apart lower horizontal beams 72, 74 are connected to platform 14, each spanning between two columns. The beam 72 can span between columns 46, 47. The beam 74 can span between the basket columns 48, 49. Vertical beams 76 span between peripheral beam 62 and lower beam 72. Similarly, vertical beams 78 span between lower horizontal beam 74 and peripheral beam 66. Upon assembly of basket 14 to base 11, stab fittings 45 of basket columns 46, 47, 48, 49 enter the sockets 42 of columns 27, 28, 29, 30 of base 11. Support columns 37, 38 engage the underside of the lower horizontal support beams 72, 74. Load transfer between the lower horizontal beams 72, 74 and the peripheral beams 62, 66 from columns 37, 38 is via vertical beams 76 and 78. Basket 14 can have fork lift tine sockets/tubes 79. Preferably at least some of the upper legs of the bottom or base 11 are different lengths to prevent mismatching of the work basket to the flange base or jack base. For example, three can be one length and the fourth can be 6 inches shorter. The legs of the flange base 12 and the jack base 11 will then have different lengths, with for example three legs of the jack base 11 having one length and a fourth leg being 6 inches longer.

Base 12 (see FIG. 24) provides a plate 80 that can be for example, about 3 inches thick. Plate 80 has opening 82 and a plurality of bolt circle openings 84 that enable attachment to a wellhead or blow out preventer. Base 12 also provides spaced apart forklift sockets 86. Four corner posts are provided at 87, 88, 89 and 90. Each corner post 87, 88, 89, 90 can be provided with a lifting eye 91. Each corner post 87, 88, 89, 90 has a socket 92 that is receptive of a stab fitting 45 of basket 14.

Figure 1:
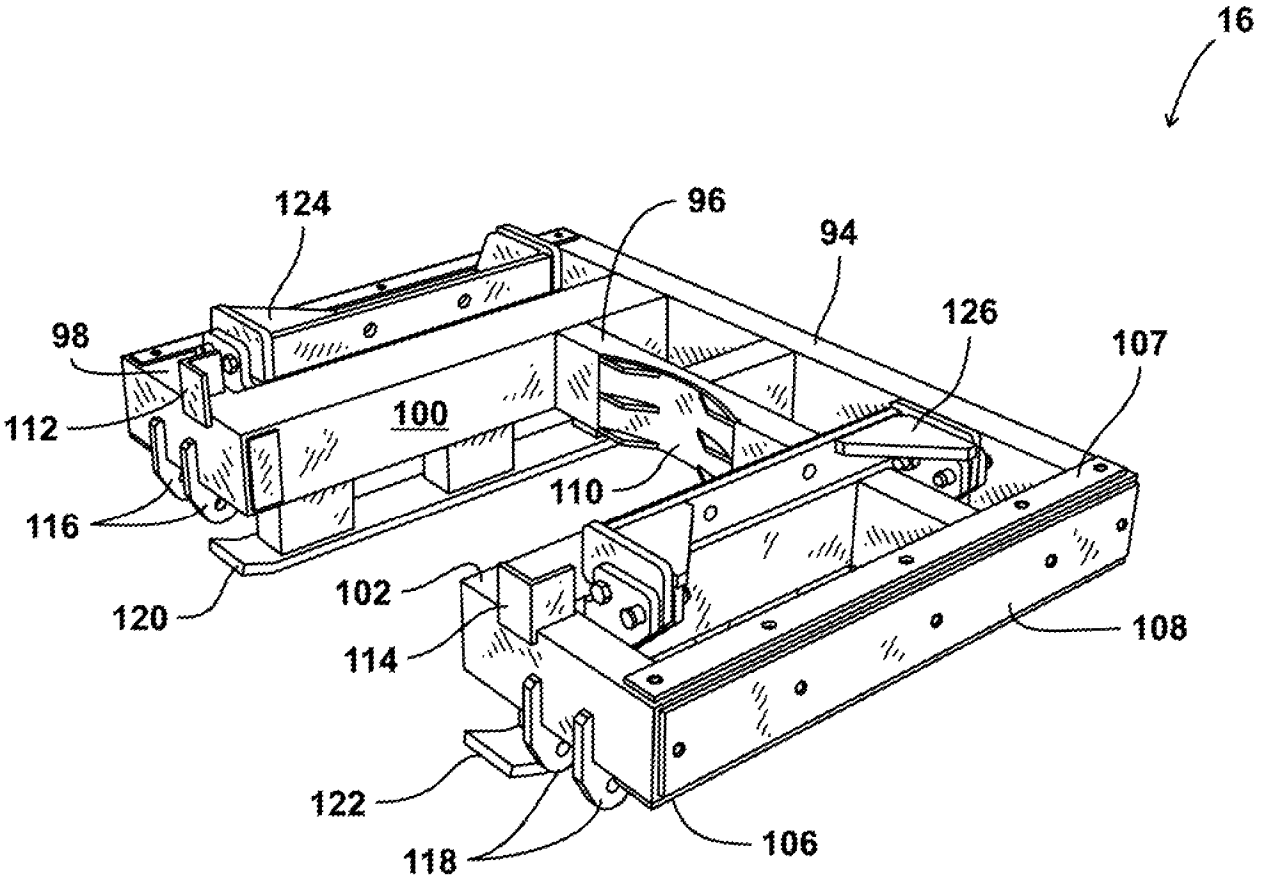
FIG. 1 is a partial perspective top view of the preferred embodiment of the apparatus of the present invention.
Figure 2:
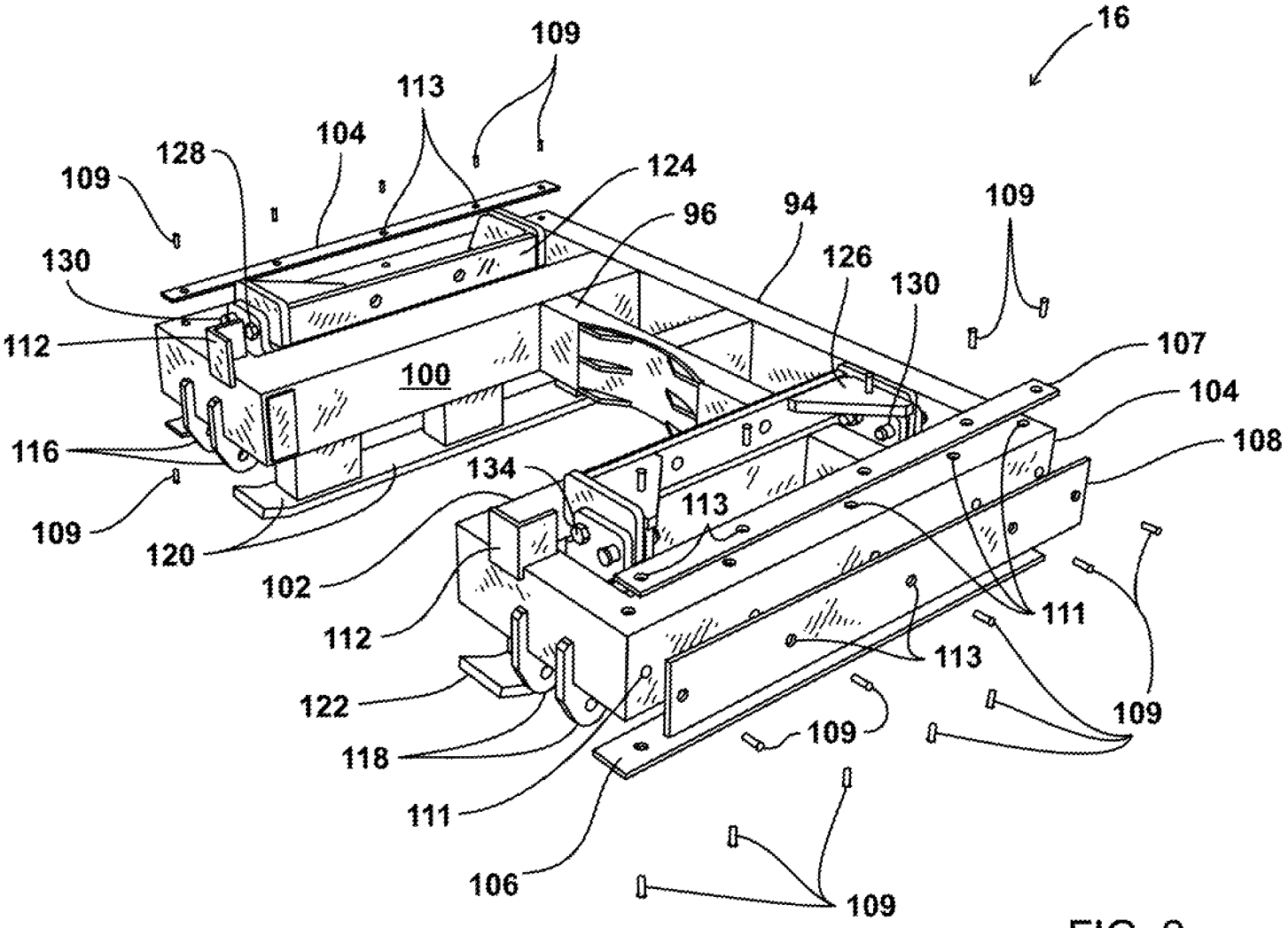
FIG. 2 is a partial perspective top view of the preferred embodiment of the apparatus of the present invention.
Figure 3:
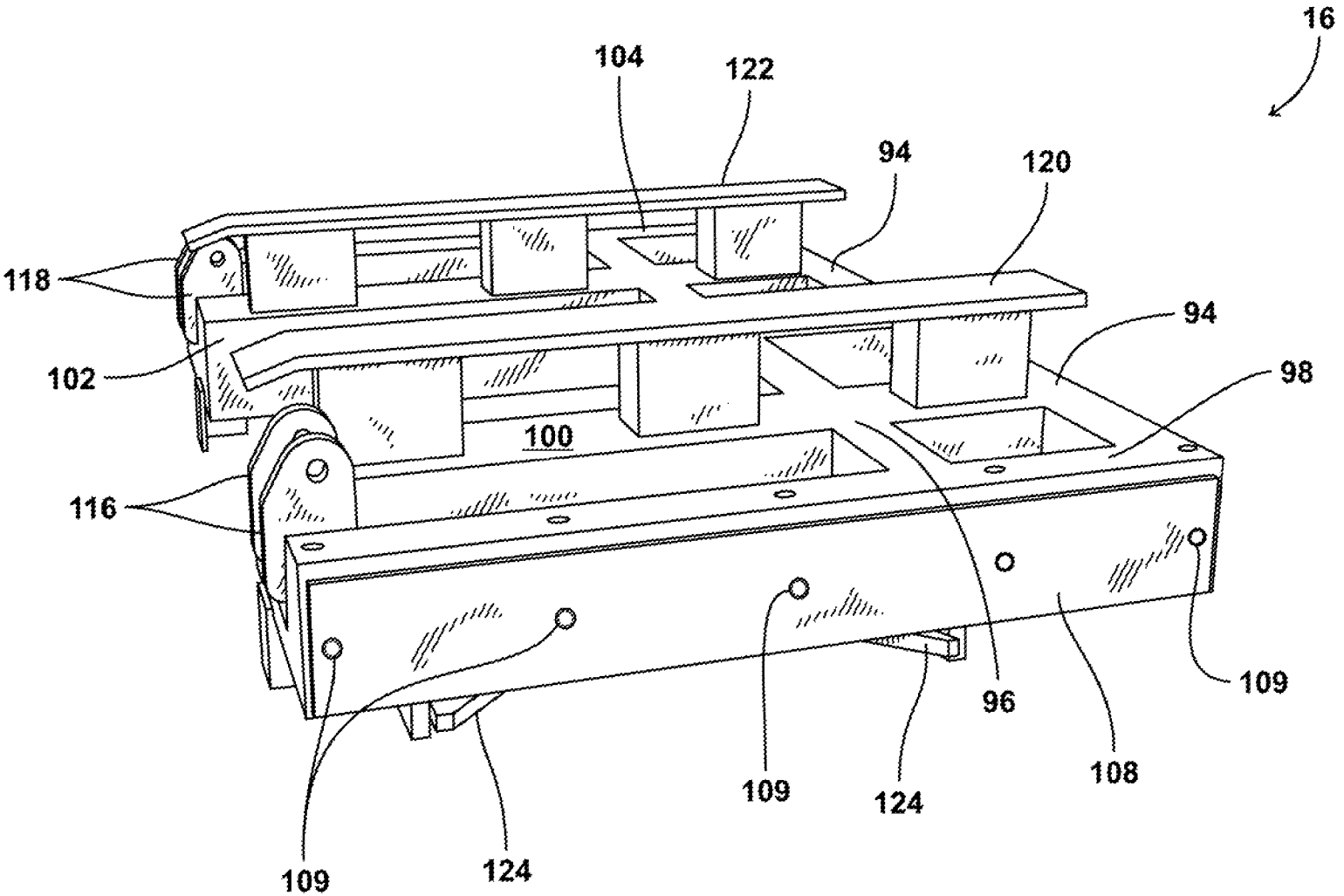
FIG. 3 is a partial perspective bottom view of the preferred embodiment of the apparatus of the present invention.

Skate or carriage 16 is shown in more detail in FIGS. 1-5. The skate or carriage 16 is generally U-shaped in plan or top view as shown in FIGS. 1-2. Skate or carriage 16 includes transverse beams 94, 96 to which are welded longitudinal beams 98, 100, 102, 104.

Each of the beams 98 and 104 is provided with multiple pads or strips 106, 107, 108 of low friction or non-skid material such as PTFE (Teflon®). Fasteners 109 (e.q. bolts, screws, rivets) can be used to secure strips 106, 107, 108 to skate 16. Each fastener 109 can attach to an internally threaded opening 111 in skate 16. Openings 113 are provided in each strip 106, 107, 108 to receive a fastener 109. Beam 96 provides a recess or arched shaped recess 110. Stops 112, 114 are provided for limiting movement of tower 20 once placed upon skate 16. Lugs 116, 118 enable connection of a hydraulic ram to skate 16 for moving it between operating and non-operating positions. Skate or carriage 16 can provide feet or skids at 120, 122.

Figure 4:
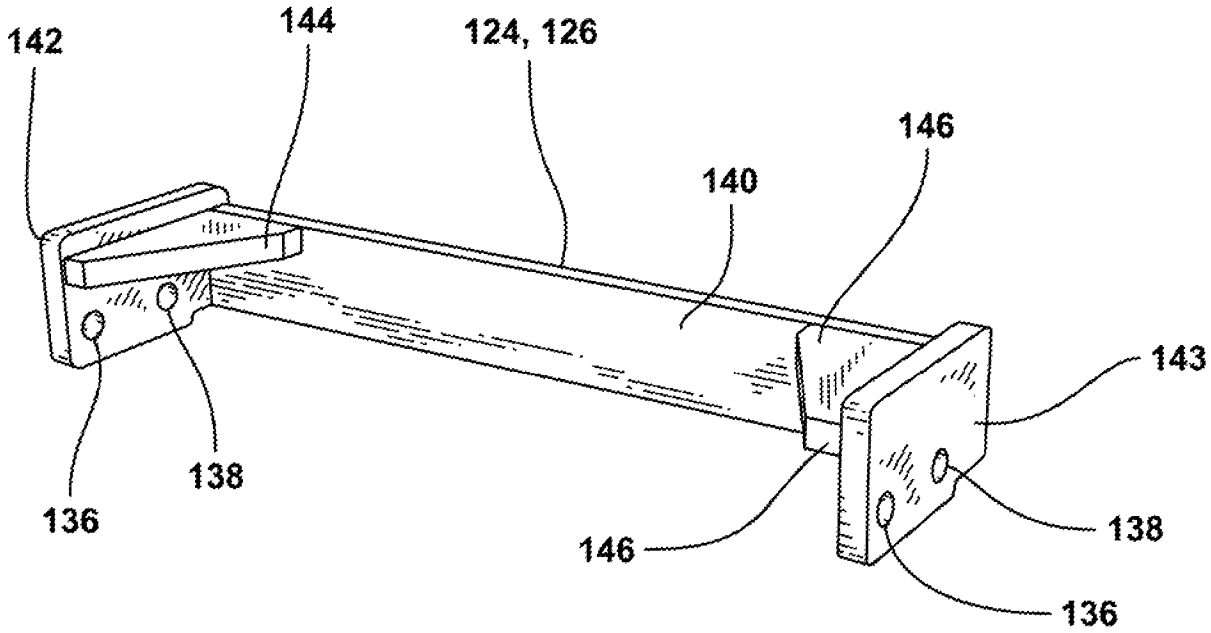
FIG. 4 is a fragmentary perspective view of the preferred embodiment of the apparatus of the present invention showing a clamp or locking member.
Figure 5:
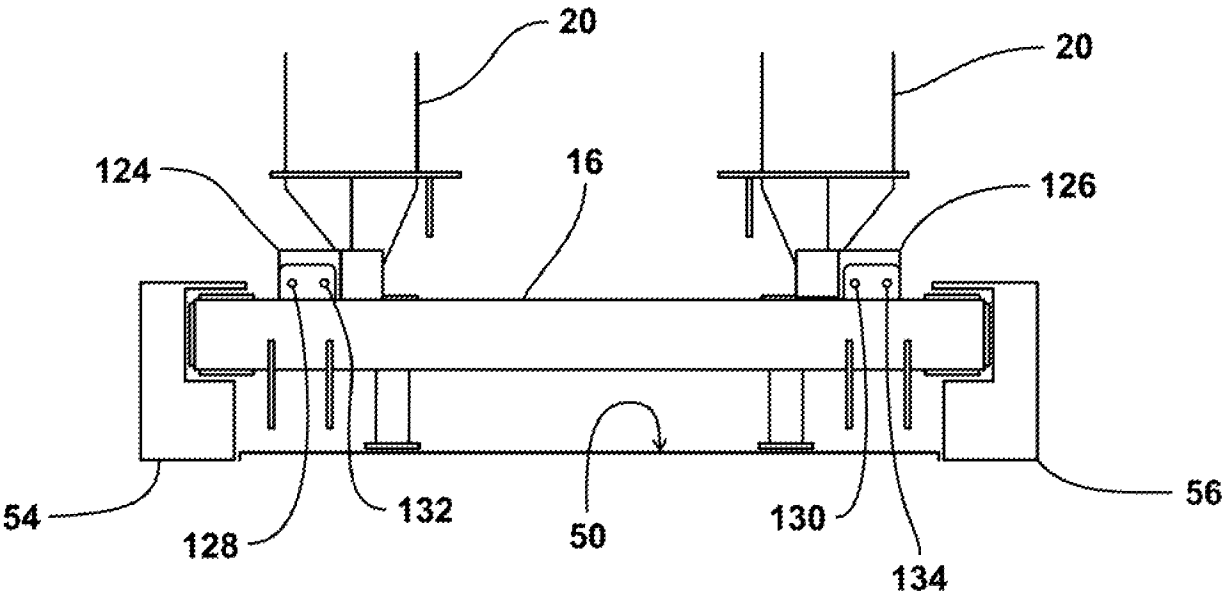
FIG. 5 is a partial sectional view of the preferred embodiment of the apparatus of the present invention.

A clamping arrangement is provided by opposed clamps 124, 126. Each clamp 124, 126 is pivotally attached to skate 16 at pivot pins or pivots 128, 130. Locking pins or locks are provided at 132, 134 for locking the clamp 124 or 126 in the clamping position of FIGS. 5 and 6. FIG. 6A shows clamps 124, 126 in an open or released position. FIG. 4 shows clamp 124, 126 in more detail. Each clamp 124, 126 can include plate 140, end plates 142, 143, reinforcements or gussets at 144, 146. Clamps 124, 126 can be of welded steel construction. Each of the end plates 142, 143 has openings including pivot openings 136 and lock pin opening 138.

Figure 18:
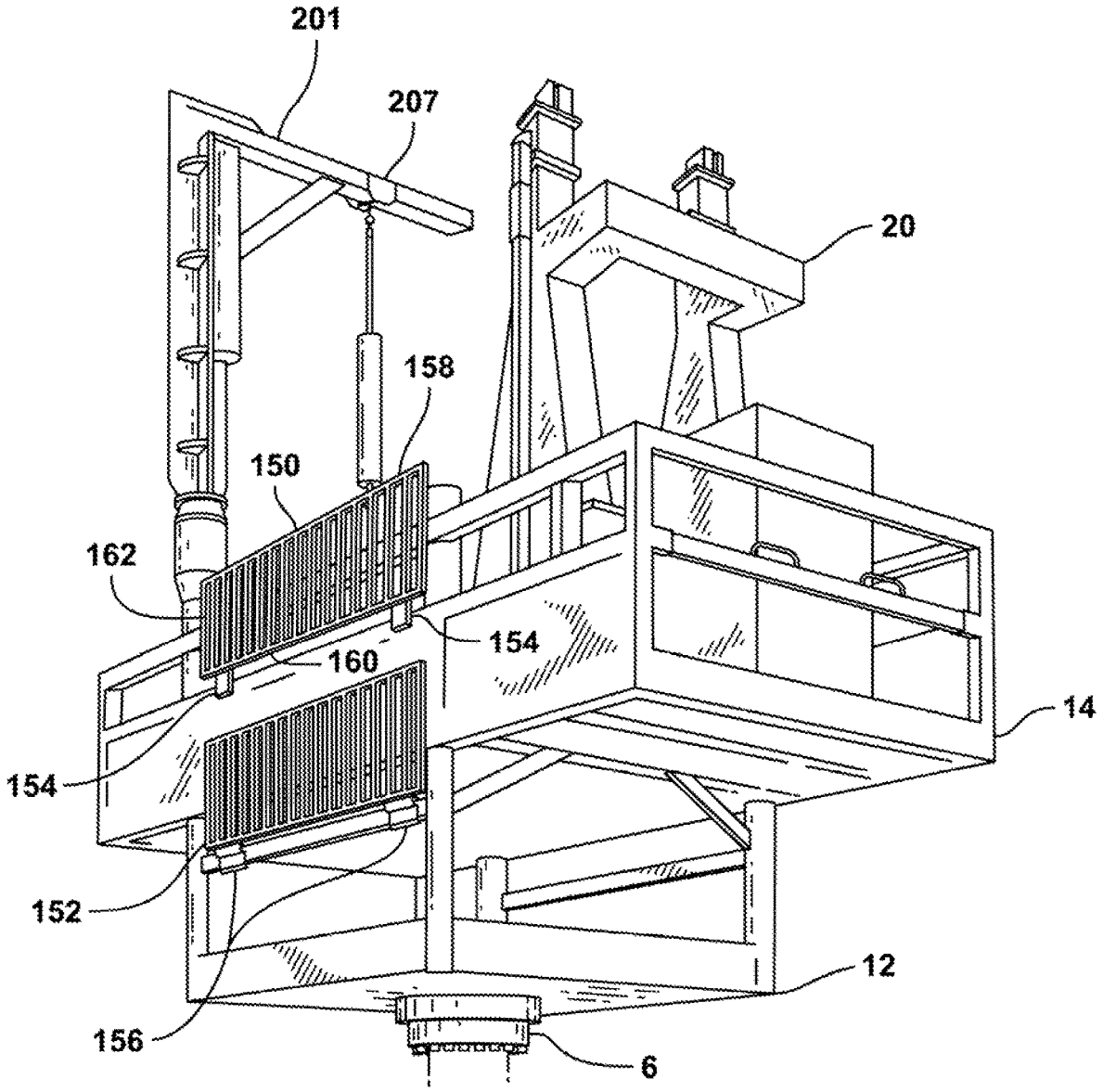
FIG. 18 is a perspective view of the preferred embodiment of the apparatus of the present invention.
Figure 19:
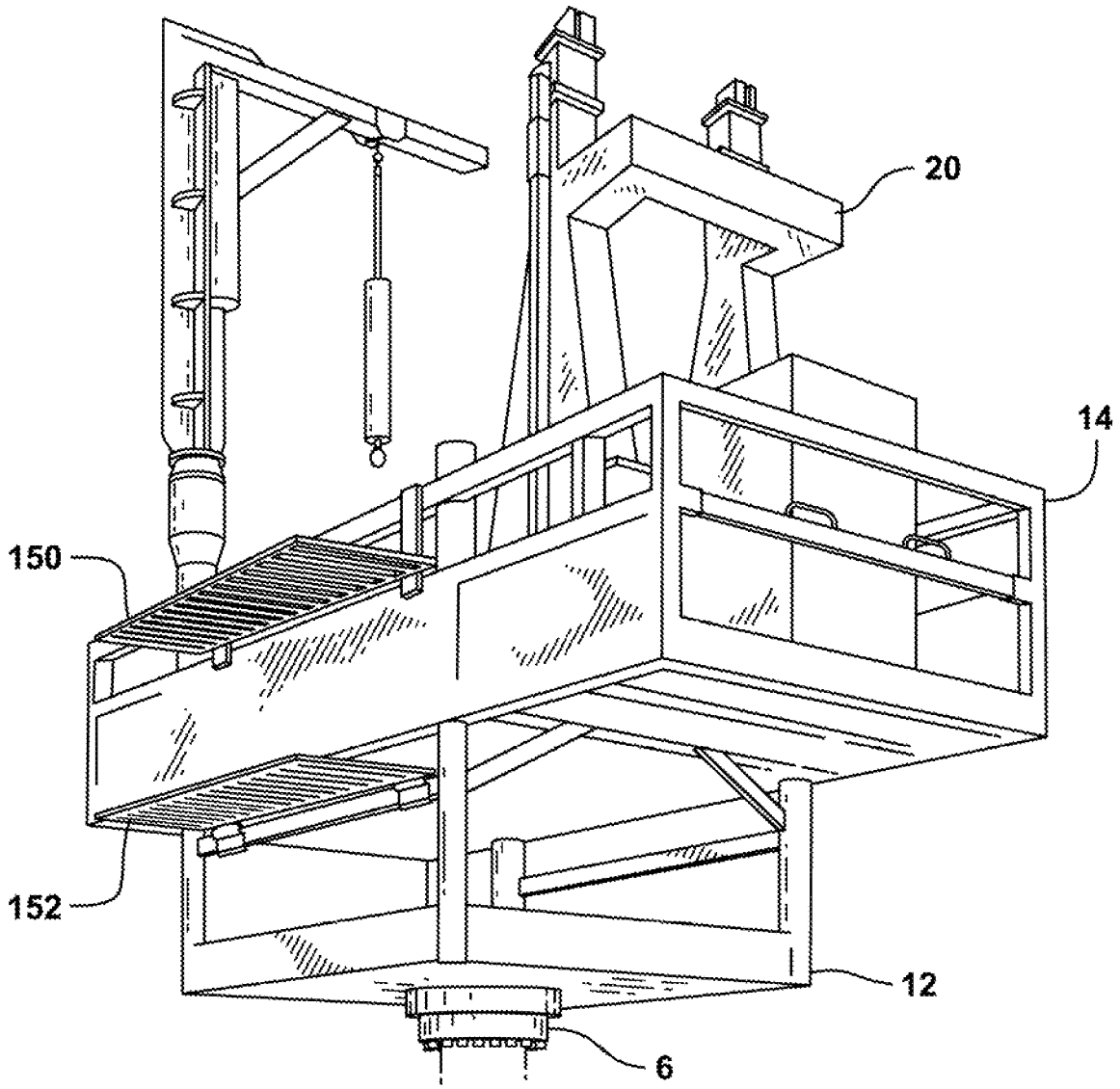
FIG. 19 is a perspective view of the preferred embodiment of the apparatus of the present invention.
Figure 20:
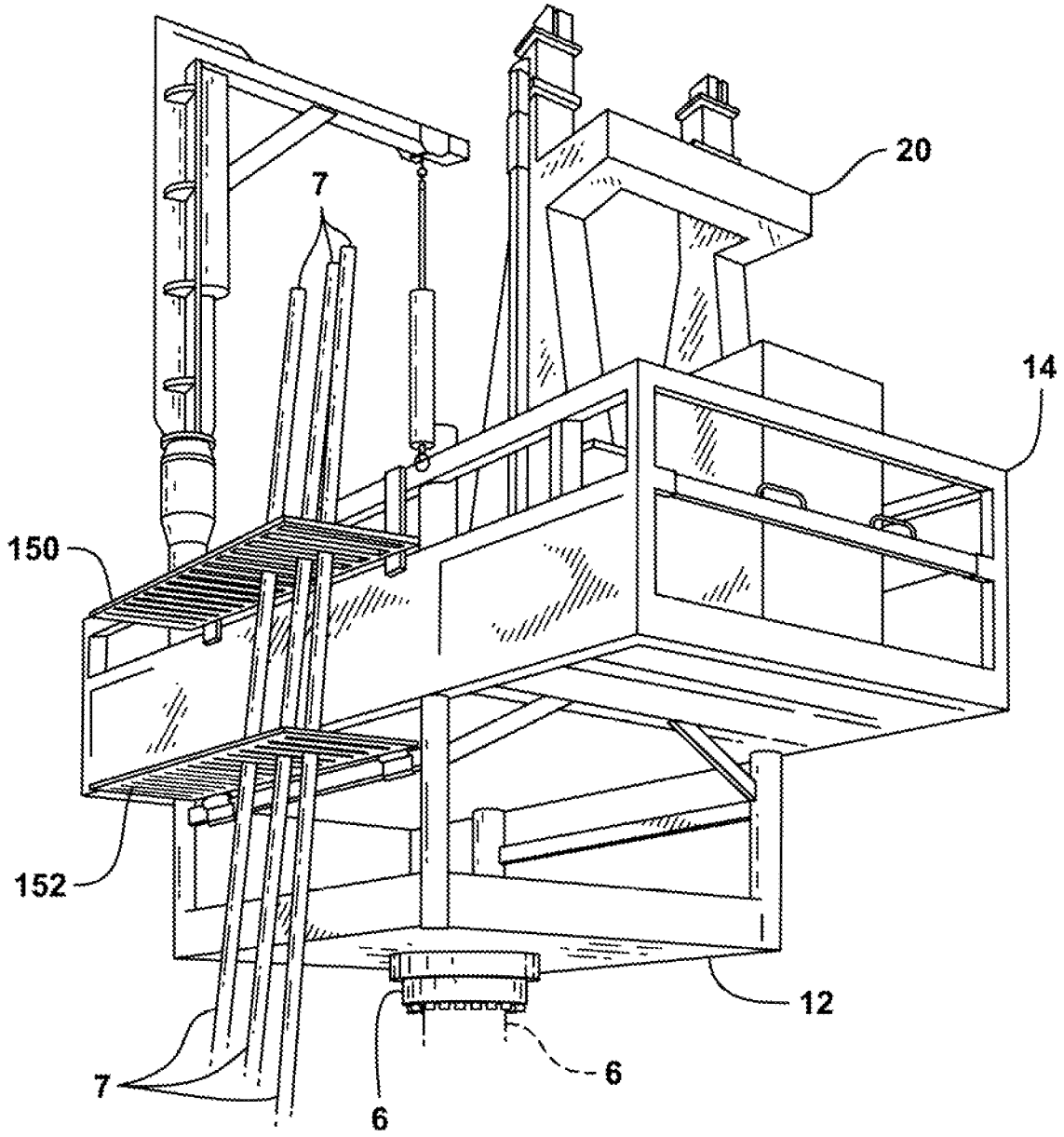
FIG. 20 is a perspective view of the preferred embodiment of the apparatus of the present invention.
Figure 21:
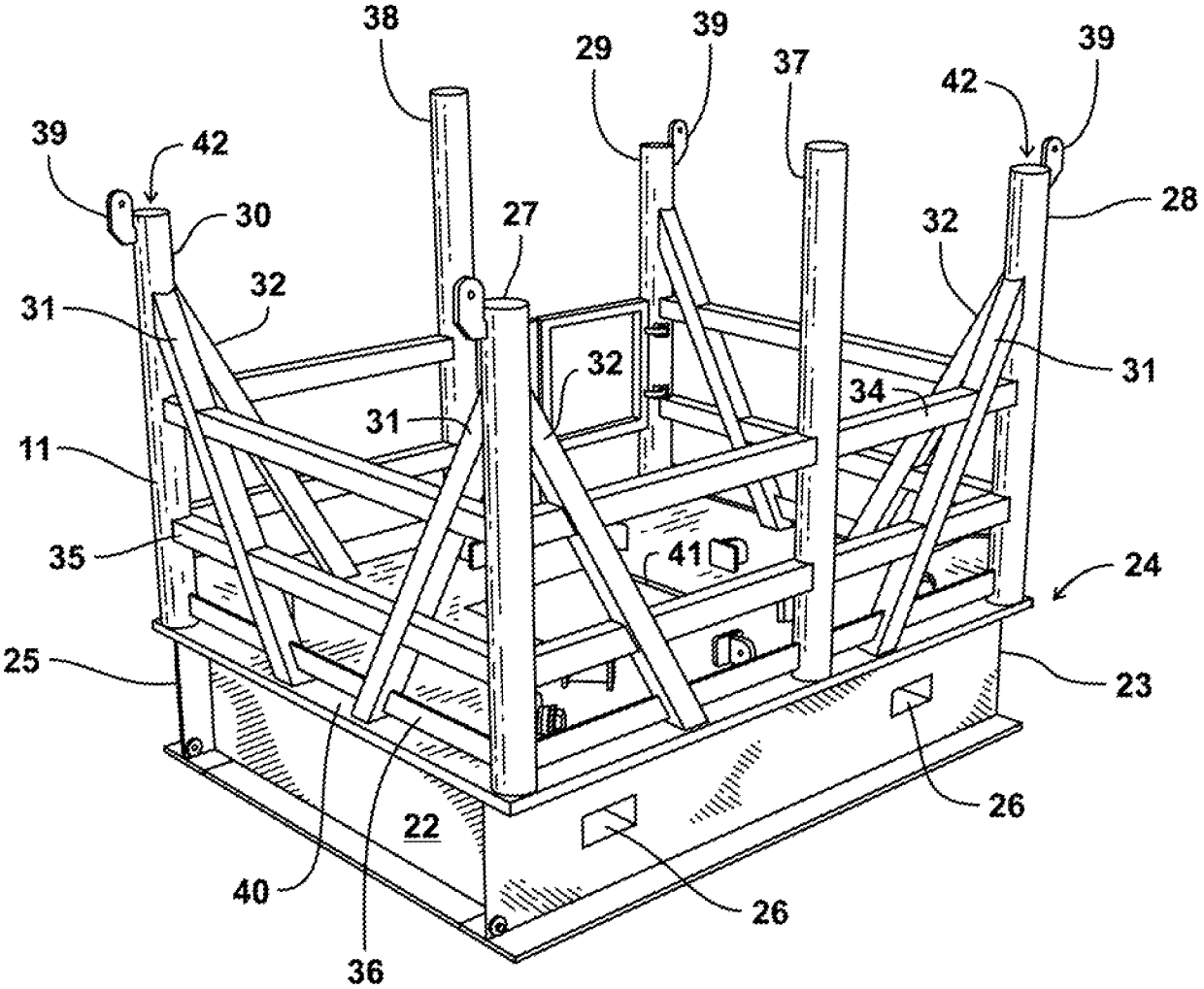
FIG. 21 is a partial perspective view of the preferred embodiment of the apparatus of the present invention.

FIGS. 18-20 show pipe supports 150, 152. Each pipe support 150, 152 pivotally attaches at a pivotal connection 154, 156 to basket 14. Each pipe support 150, 152 includes longitudinal members 158, 160 and a plurality of transverse members 162.

Upper level jack platform with load transfer member 250 (see FIG. 25) includes a jack platform 251 and a load transfer member 252. Load transfer member 252 includes a cylindrical support 253 and gussets 254 attached to cylindrical support 253 and supporting jack platform 251. Stabilizing flanges 255 (one at each end of jack platform 251) are attached to jack platform 251, and angled down toward the floor of the basket. There is a cylindrical opening 256 in upper level jack platform 251 which passes through support 253 and aligns with opening 266 in the flange base when upper level jack platform with load transfer member 250 is properly placed on the flange base.

The bottom of the load transfer cone contacts the flange plate and transfers force to the 3" flange base then to the wellhead. When properly placed on the flange base, the opening 256 in the upper level jack platform 250 aligns with the opening in the flange base. While referred to herein as a cone, the load transfer member 252 is preferably a cylindrical support 253 with gussets 254 attached thereto and supporting jack platform 251.

Figure 27:
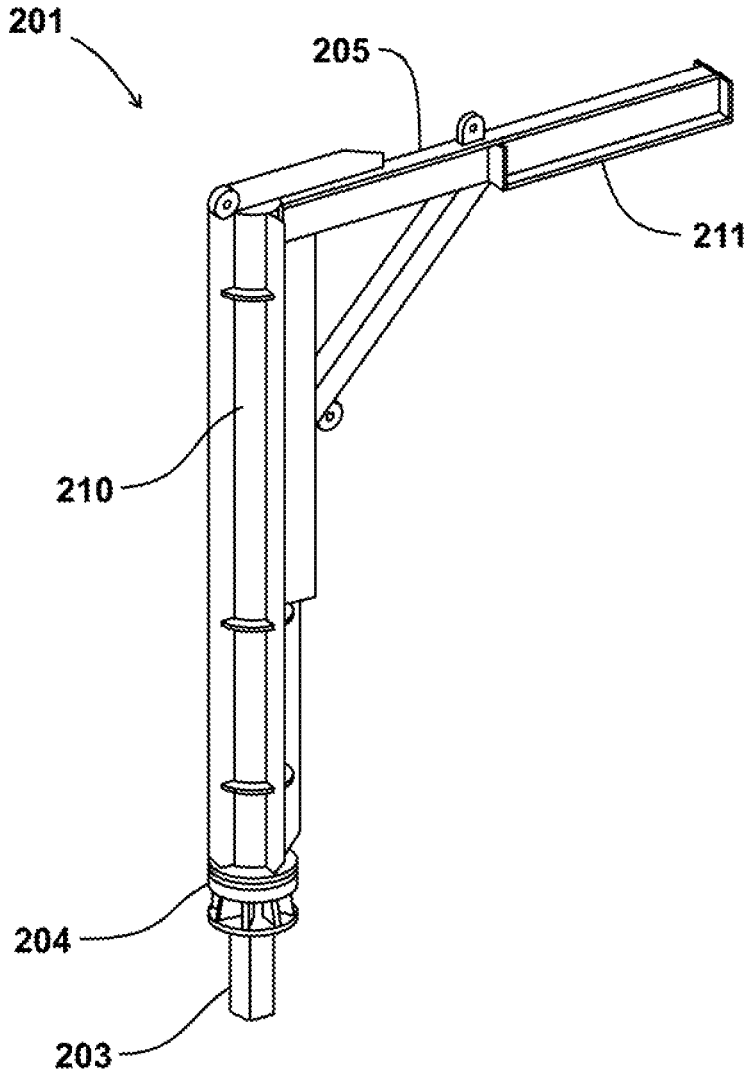
FIG. 27 shows details of a boom assembly.
Figure 28:
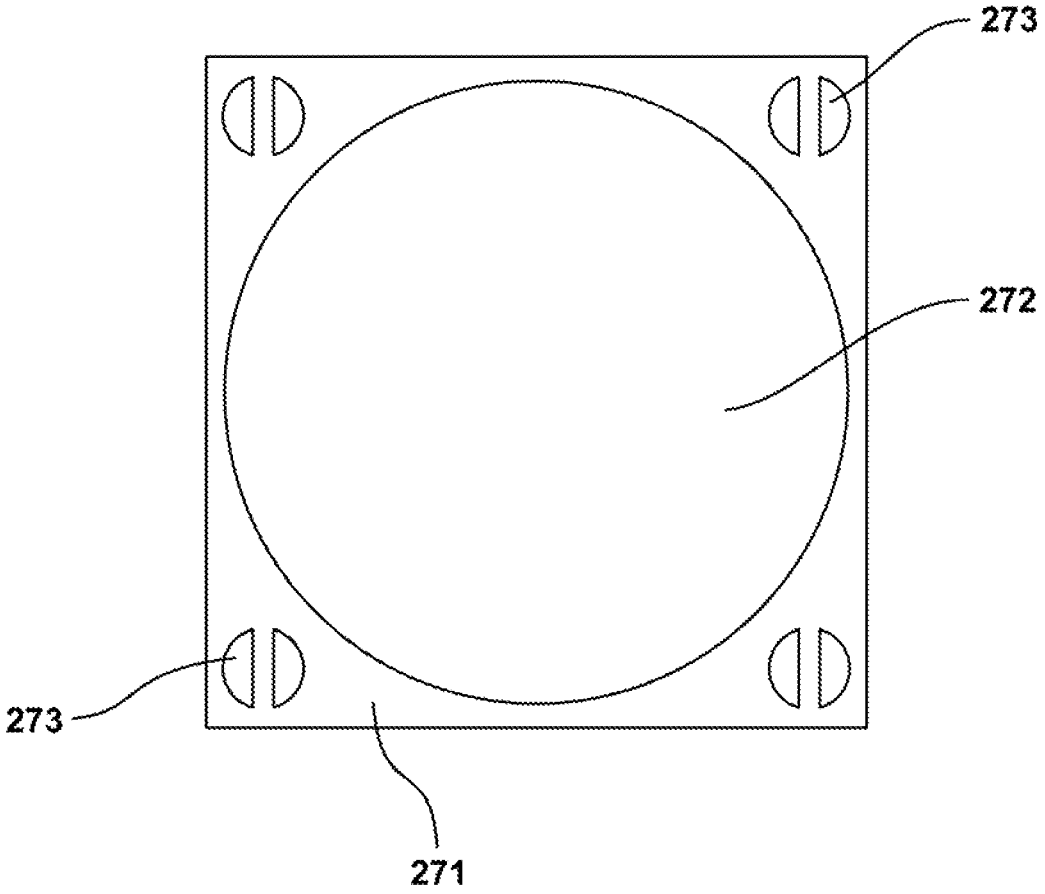
FIGS. 28 and 29 show plates which can be used in the present invention.
Figure 29:
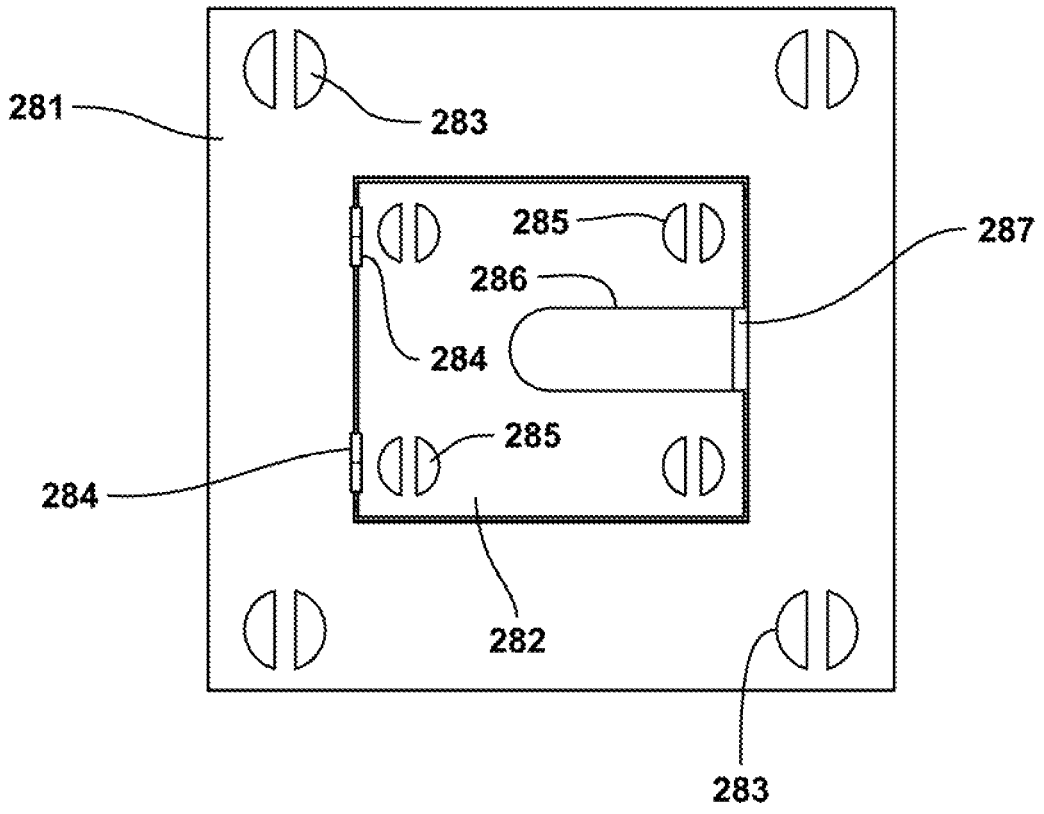

Rotating boom assembly 201 (see FIG. 27) includes a boom base receiving socket 202 (BA 33) which receives boom base 203 (see Sheet 32 and BA 34). Socket 202 is preferably above the railings of the basket. A bearing assembly 204 is secured to the boom base (preferably with bolts as shown). Boom 205 includes a hydraulic arm 206 which is pinned to the boom vertical support 210 (via mounting bracket 212) and pinned to the wheeled carriage 207 (via mounting bracket 213 on wheeled carriage 207). Carriage 207 includes vertically oriented wheels 208 (on each side of boom 205) and horizontally oriented wheels 209 of carriage (bears against lip 211). Lip 211 on boom 205 supports wheeled carriage 207 (one lip on each side of boom 205) and wheels 208 ride on the lip 211.

The following is a list of parts and materials suitable for use in the present invention.

PARTS LIST

PART NO. DESCRIPTION

5 crane
6 wellhead
7 tubular/casing section/pipe section
8 swivel/hydraulic swivel
9 beam/I beam
10 swivel stand apparatus
11 base/jack base/lower level
12 base/flange base/lower level
13 jack
14 basket/upper level
15 deck plate
16 skate/carriage
19 bore
20 mast/tower
21 foot/flanged beam
22 beam
23 beam
24 beam
25 beam
26 fork lift tine socket
27 corner column/leg
28 corner column/leg
29 corner column/leg
30 corner column/leg
31 diagonal support
32 diagonal support
34 upper horizontal member
35 mid level horizontal member
36 lower horizontal member
37 support column
38 support column
39 lifting eye
40 deck/floor
41 opening
42 socket
45 stab fitting
46 basket column
47 basket column
48 basket column
49 basket column
50 deck
52 deck opening
54 flanged beam/channel beam
56 flanged beam/channel beam
58 deck beams
60 peripheral beams
62 peripheral beams
64 peripheral beams
66 peripheral beams
68 grating
70 rail
71 entry door
72 lower horizontal beam
74 lower horizontal beam
76 vertical beam
78 vertical beam
79 fork lift tube/socket
80 plate
81 flange
82 opening
83 plate
84 bolt circle opening
85 flange
86 fork lift socket/tube
87 corner post
88 corner post
89 corner post
90 corner post
91 lifting eye
92 socket
93 sleeve
94 transverse beam
95 gusset/reinforcement
96 transverse beam
98 longitudinal beam
100 longitudinal beam
102 longitudinal beam
104 longitudinal beam
106 pad/strip
107 pad/strip
108 pad/strip
109 fastener/bolt/screw
110 recess/arc shaped recess
111 internally threaded opening
112 stop
113 opening
114 stop
116 lug
118 lug
120 foot/skid
122 foot/skid
5
10
15
20
25
124 clamp
126 clamp
128 pivot pin/pivot
130 pivot pin/pivot
132 lock/locking pin
134 lock/locking pin
136 pivot opening
138 lock pin opening
140 plate
142 end plate
143 end plate
144 gusset
146 gusset
150 pipe support

152 pipe support
154 pivotal connection
156 pivotal connection
158 longitudinal member
160 longitudinal member
162 transverse member
201 boom assembly
202 boom base receiving socket (BA 33)
203 boom base
204 low torque bearing assembly
205 boom
206 hydraulic arm (hoses not show in drawings)
207 wheeled carriage
208 vertically oriented wheels of carriage (on each side of boom)
209 horizontally oriented wheel of carriage (bears against lip 211)
210 vertical support of boom 205
211 lip on boom 205 for supporting wheeled carriage 207 (one lip on each side of boom 205)
212 mounting bracket of arm 206 on vertical support 210 to which arm 206 is pinned
213 mounting bracket on wheeled carriage 207 to which arm 206 is pinned
250 upper level jack platform with load transfer member/cone
251 jack platform
252 load transfer member
253 cylindrical support of load transfer member 252
254 gussets attached to cylindrical support 253 and supporting jack platform 251
255 stabilizing flanges (one at each end of jack platform 251) attached to jack platform 251, and angled down toward the floor of the basket
256 cylindrical opening in upper level jack platform
266 opening in flange base 12
268 bolts protruding above flange base 12 through bolt openings 84
269 nuts on bolts 268 securing wellhead below to flange base 12
271 drop-in square plate with jack opening (Sheet 28)
272 jack opening in plate 271
273 lifting points in plate 271
281 drop-in square plate with hinged door (Sheet 29)
282 hinged door in plate 281
283 lifting points in plate 281
284 hinges for door 282
285 lifting points in door 282
286 opening in door 282 for tubing and tools
287 lip for distal end of door 282 to rest upon All measurements disclosed herein are at standard temperature and pressure, at sea level on Earth, unless indicated otherwise. All materials used or intended to be used in a human being are biocompatible, unless indicated otherwise. The foregoing embodiments are presented by way of example only; the scope of the present invention is to be limited only by the following claims.

The invention claimed is:

1. A modular swivel stand apparatus comprising:

a) first and second base structures, each having multiple perimeter legs, the first base structure being a flange base and having a bolt circle for attaching to a wellhead, the second base structure being a jack base and having securing gussets for securing a jack to the second base structure;

b) a basket structure that removably connects to a selected one of the first and second base structures, the basket structure having basket legs that connect to the base perimeter legs of the selected base and a basket floor;

c) spaced apart basket beams on the basket structure;

d) a carriage that mounts to the basket beams, the carriage including spaced apart carriage beam members, a transverse beam that spans between said carriage beam members and a space in between said carriage beam members and in front of said transverse beam;

e) a mast tower removably affixable to the carriage;

f) a mechanism to secure the mast tower to the carriage; and g) first, second, and third square plates for being received in an opening in the basket floor, the first square plate having an opening therein to allow a jack to protrude therethrough, the second square plate having a hinged door, and the third square plate including a load transfer member sized and shaped to rest on the first base structure while causing the third square plate to project slightly above the basket floor.

2. The modular swivel stand apparatus of claim 1 wherein said carriage beam members are parallel.

3. The modular swivel stand apparatus of claim 1 further comprising one or more friction reducers of low friction material forming an interface between the carriage beam members and the basket beams.

4. The modular swivel stand apparatus of claim 3 wherein the friction reducers are non-wheeled.

5. The modular swivel stand apparatus of claim 3 wherein the friction reducers are wear strips.

6. The modular swivel stand apparatus of claim 1 wherein the basket beams are parallel.

7. The modular swivel stand apparatus of claim 1 wherein said tower has spaced apart feet that rest upon the carriage.

8. The modular swivel stand apparatus of claim 1 further comprising a ribbed load transfer cone and plate for transferring load from an upper deck of a platform to a lower platform to a wellhead or blow out preventer.

9. A swivel stand apparatus comprising:

a) a base structure having multiple perimeter legs;

b) a basket structure that removably connects to the base structure, the basket structure having basket legs that connect to the base perimeter legs;

c) spaced apart basket beams on the basket structure;

d) a carriage that mounts to the basket beams, the carriage including spaced apart carriage beam members, a transverse beam that spans between said carriage beam members and a space in between said carriage beam members and in front of said transverse beam;

e) a mast tower removably affixable to the carriage; and f) a clamping mechanism that secures the mast tower to the carriage, said clamping mechanism movable between clamping and release positions.

10. The swivel stand apparatus of claim 9 wherein said carriage beam members are parallel.

11. The swivel stand apparatus of claim 9 further comprising one or more friction reducers of low friction material forming an interface between the carriage beam members and the basket beams.

12. The swivel stand apparatus of claim 11 wherein the friction reducers are non-wheeled.

13. The swivel stand apparatus of claim 11 wherein the friction reducers are wear strips.

14. The swivel stand apparatus of claim 9 wherein the basket beams are parallel.

15. The swivel stand apparatus of claim 9 wherein said mast tower has spaced apart feet that rest upon the carriage.

16. The swivel stand apparatus of claim 9 further comprising a ribbed load transfer cone and plate for transferring load from an upper deck of a platform to a lower platform to a wellhead or blow out preventer.

17. The swivel stand apparatus of claim 9 wherein the clamping mechanism is mounted to the carriage.

18. The swivel stand apparatus of claim 17 wherein the clamping mechanism includes first and second clamping members.

19. The swivel stand apparatus of claim 18 wherein each clamping member is mounted to a different one of said carriage beam members.

* * * * *